US007509062B2

(12) United States Patent
Kikuchi et al.

(10) Patent No.: US 7,509,062 B2
(45) Date of Patent: Mar. 24, 2009

(54) METHOD AND APPARATUS FOR IMAGE FORMING CAPABLE OF EFFECTIVELY RECYCLING IMAGE FORMING UNIT

(75) Inventors: Hideo Kikuchi, Kanagawa-ken (JP); Takundo Isobe, Chiba-ken (JP)

(73) Assignee: Ricoh Company, Ltd., Tokyo (JP)

( * ) Notice: Subject to any disclaimer, the term of this patent is extended or adjusted under 35 U.S.C. 154(b) by 347 days.

(21) Appl. No.: 11/203,973

(22) Filed: Aug. 16, 2005

(65) Prior Publication Data

US 2006/0034627 A1 Feb. 16, 2006

(30) Foreign Application Priority Data

Aug. 16, 2004 (JP) ..... 2004-236740

(51) Int. Cl.
*G03G 15/00* (2006.01)

(52) U.S. Cl. ..... 399/24; 399/25; 399/26; 399/109; 399/113

(58) Field of Classification Search ..... 399/24, 399/25, 26, 109, 110, 113
See application file for complete search history.

(56) References Cited

U.S. PATENT DOCUMENTS 5,196,884 A * 3/1993 Sugiyama et al. ..... 399/110
2005/0078969 A1 4/2005 Kikuchi
2005/0084272 A1 4/2005 Kikuchi
2005/0117918 A1 * 6/2005 Kimura et al. ..... 399/24

FOREIGN PATENT DOCUMENTS

JP 2000-347550 12/2000
JP 2002062768 A * 2/2002
JP 2002-182532 6/2002
JP 3571584 7/2004

OTHER PUBLICATIONS

U.S. Appl. No. 11/227,488, filed Sep. 16, 2005, Kikuchi.

* cited by examiner

*Primary Examiner*—David M Gray
*Assistant Examiner*—Laura K Roth
(74) *Attorney, Agent, or Firm*—Oblon, Spivak, McClelland, Maier & Neustadt, P.C.

(57) ABSTRACT

An image forming apparatus which allows an independent and easy replacement of replaceable image forming devices including an image forming unit detachably provided in the image forming apparatus. The image forming unit includes a housing, a plurality of replaceable devices, and a nonvolatile memory. The plurality of replaceable devices are replaceably mounted inside the housing. The nonvolatile memory is mounted on the housing and stores lifetime information of the image forming unit and each one of the plurality of replaceable devices.

18 Claims, 25 Drawing Sheets

METHOD AND APPARATUS FOR IMAGE FORMING CAPABLE OF EFFECTIVELY RECYCLING IMAGE FORMING UNIT

CROSS REFERENCE TO RELATED APPLICATION

This application claims priority to Japanese patent application no. 2004-236740 filed on Aug. 16, 2004, the disclosure of which is incorporated by reference herein in its entirety.

BACKGROUND OF THE INVENTION

1. Field of the Invention

The present invention relates to a method and apparatus for image forming, and more particularly to a method and apparatus for image forming capable of effectively recycling an image forming unit.

2. Discussion of the Background Art

In a background image forming apparatus, a toner cartridge or a process cartridge is detachably provided in the background image forming apparatus as an image forming unit, and includes a nonvolatile memory which stores lifetime information such as guarantee information and operation information of the toner cartridge. In the background image forming apparatus, the nonvolatile memory stores the guarantee information of the process cartridge obtained by conversion into the number of rotations of a photoconductor, the number of recording operations of a transfer member, and/or the number of pixels. The guarantee information of the process cartridge is compared with the actual number of rotations of the photoconductor, the actual number of recording operations of the transfer member, or the number of pixels. The lifetime of the process cartridge is determined based on a result of the comparison, and a need for replacement of the process cartridge is informed. Further, guarantee information (e.g., information of a limit number of reproduction operations) of each of individual replaceable component or device (hereinafter referred to as replaceable members) included in the process cartridge is determined based on such factors as the number of replacements of the photoconductor, and the guarantee information is stored in the nonvolatile memory. The guarantee information of the replaceable members is read in a reproduction operation of the process cartridge to find a component or device which is worn. The component may then be replaced before failure.

However, in the background process cartridge, when the photoconductor is detected to be worn out and replaced with a new one, such components as a charging device and a cleaning device attached around the photoconductor need to be detached from a housing of the process cartridge, even though the components are not yet at the end of their respective lives. That is, in the background process cartridge, when one of the replaceable members included in the process cartridge is detected to be at the end of its life and is replaced, other replaceable members need to be detached from the housing of the process cartridge, even though the replaceable members are not yet at the end of their lives. Therefore, it takes a relatively long time to replace the replaceable members, and a replacement operation is troublesome.

Further, the lifetime of the background process cartridge attached to the image forming apparatus is detected based on the guarantee information of the process cartridge obtained by conversion into the number of rotations of the photoconductor. It is in the reproduction operation of the process cartridge that whether the replaceable members in the process cartridge are at the end of their lives and thus need to be replaced is determined. Therefore, in the background process cartridge, even if any one of the replaceable members in the process cartridge is at the end of its life, the replaceable member continues to be used unless the process cartridge is detected to be at the end of its lifetime. As a result, an obtained image and other components and devices may deteriorate because the replaceable member is at the end of its life.

SUMMARY OF THE INVENTION

This patent specification describes a novel image forming apparatus which allows independent and easy replacement of replaceable image forming devices. In one aspect, a novel image forming apparatus includes an image forming unit detachably provided in the image forming apparatus. The image forming unit includes a housing, a plurality of replaceable devices, and a nonvolatile memory. The plurality of replaceable devices are replaceably mounted inside the housing. The nonvolatile memory is mounted on the housing and stores lifetime information of the image forming unit and each one of the plurality of replaceable devices.

This patent specification further describes a novel process cartridge for use in an image forming apparatus and which allows independent and easy replacement of replaceable image forming devices. In one aspect, a novel process cartridge exchangeably used in an image forming apparatus includes a housing, a plurality of replaceable devices, and a nonvolatile memory. The plurality of replaceable devices are replaceably mounted inside the housing. The nonvolatile memory is mounted on the housing and stores lifetime information, based on which, ends of lives are detectable with respect to the process cartridge and each of the plurality of replaceable devices.

This patent specification further describes a novel method of recycling an image forming unit including a plurality of replaceable devices and used in an image forming apparatus. In one aspect, a novel method includes storing lifetime information of each one of the plurality of replaceable devices into the nonvolatile memory. The method includes storing lifetime information of the image forming unit into a nonvolatile memory. The method further includes reading the lifetime information of each one of the plurality of replaceable devices from the nonvolatile memory. The method further includes replacing a replaceable device worn out to an end of its lifetime with a new replaceable device based on the lifetime information read in the reading step.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
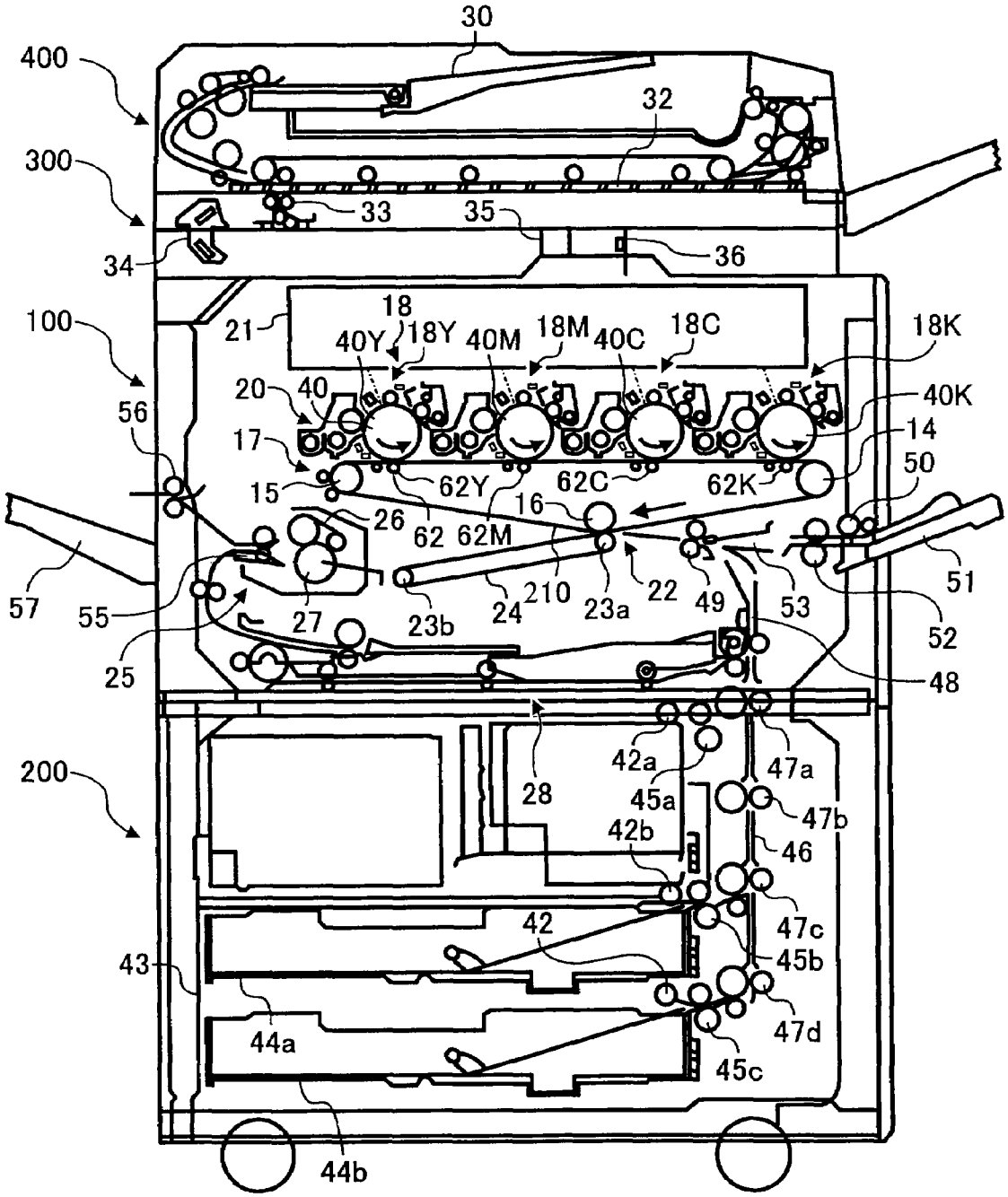
FIG. 1 is a schematic view of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, an image forming apparatus 100 according to an embodiment of the present invention is described.

FIG. 1 is a schematic view illustrating a configuration of the image forming apparatus 100, which is a tandem-type color copier using an indirect transfer method. The image forming apparatus 100 is placed on a sheet-feeding table 200. A scanner 300 and an ADF (automatic document feeder) 400 are placed on the image forming apparatus 100.

The image forming apparatus 100 includes an intermediate transfer member 210, support rollers 14, 15, and 16, an intermediate transfer member cleaning device 17, four image forming units 18Y, 18C, 18M, and 18K, a tandem image forming mechanism 20, image carrying members 40Y, 40C, 40M, and 40K, first transfer rollers 62Y, 62C, 62M, and 62K, an exposure device 21, a second transfer device 22, two rollers 23*a* and 23*b*, a second transfer belt 24, a fixing device 25, a fixing belt 26, a press roller 27, and a sheet reversing device 28, a sheet path 48, a registration roller pair 49, a sheet-feeding roller 50, a manual sheet-feeding tray 51, a separation roller pair 52, a manual sheet path 53, a switching claw 55, a discharge roller pair 56, and a discharge tray 57. Photoconductors are used as the image carrying members 40Y, 40C, 40M, and 40K in this example.

The sheet-feeding table 200 includes sheet-feeding rollers 42*a* to 42*c*, a paper bank 43, sheet cassettes 44*a* and 44*b*, separation roller pairs 45*a* to 45*c*, a sheet path 46, and conveyance roller pairs 47*a* to 47*d*.

The scanner 300 includes a contact glass 32, a first running member 33, a second running member 34, an imaging lens 35, and a reading sensor 36.

The ADF 400 includes a document tray 30.

The intermediate transfer member 210 is loop-shaped and provided in a substantial center of the image forming apparatus 100 as a transfer member. The intermediate transfer member 210 passes over the three support rollers 14, 15, and 16 to rotate and convey a recording medium thereon in a clockwise direction in the figure. The intermediate transfer member cleaning device 17 is provided at a left side of the support roller 15. The intermediate transfer member cleaning device 17 removes toner remaining on the intermediate transfer member 210 after a transfer operation of a toner image from the intermediate transfer member 210 to the recording medium. The four image forming units 18Y, 18C, 18M, and 18K are arranged in a line on the intermediate transfer member 210 extending between the support rollers 14 and 15 in a direction of conveying the recording medium. The image forming units 18Y, 18C, 18M, and 18K form yellow (Y) toner images, cyan (C) toner images, magenta (M) toner images, and black (K) toner images, respectively.

In the following description of components of the image forming apparatus 100, a component is referred to by a number without a suffix of Y, C, M or K in a description where the distinction of toner colors is not necessary, and is referred to by a number plus the suffix Y, C, M or K, where such distinction is necessary.

The image forming unit 18 includes the image carrying member 40, and its surrounding devices such as a charging device 4 (illustrated in FIG. 3), a development device 5 (illustrated in FIG. 3), the first transfer roller 62 serving as a transfer device, an image carrying member cleaning device 2 (illustrated in FIG. 3), and a neutralization device (not illustrated). The exposure device 21 is provided above the tandem image forming mechanism 20. The image carrying member 40, the charging device 4, the development device 5, and the image carrying member cleaning device 2 are stored in a single housing 7 (illustrated in FIG. 3) to form a process cartridge 1 (illustrated in FIG. 3) which is detachably provided in the image forming apparatus 100. The image forming units 18Y, 18C, 18M, and 18K form toner images of different colors on the respective image carrying members 40Y, 40C, 40M, and 40K, and form the tandem image forming mechanism 20.

shown in FIG. 1, the second transfer device 22 is provided as another transfer device, facing the tandem image forming mechanism 20 via the intermediate transfer member 210. The second transfer device 22 includes the two rollers 23*a* and 23*b*, and the loop-shaped second transfer belt 24 passing over the two rollers 23*a* and 23*b*. Further, the second transfer device 22 is pressed against the support roller 16 via the intermediate transfer member 210, so that a toner image carried on the intermediate transfer member 210 is transferred to the recording medium.

The fixing device 25 is provided at a downstream position of the second transfer belt 24 in a conveying direction of the recording medium to fix the toner image on the recording medium. The fixing device 25 includes the loop-shaped fixing belt 26 and the press roller 27 pressed against the fixing belt 26. The sheet reversing device 28 is provided below the second transfer device 22 and the fixing device 25 in parallel with the tandem image forming mechanism 20 to reverse the recording medium and form toner images on both surfaces of the recording medium.

In a copying operation performed by the image forming apparatus 100, an original document is placed on the document tray 30 in the ADF 400. Alternatively, the ADF 400 is opened, and the original document is placed on the contact glass 32 of the scanner 300. Then, the ADF 400 is closed to hold the original document.

In a case in which the original document is placed on the document tray 30 of the ADF 400, when a start switch (not illustrated) is pressed, the original document is conveyed onto the contact glass 32, and the scanner 300 is driven to move the first and second running member 33 and 34. In a case in which the original document is placed on the contact glass 32, the scanner 300 is driven immediately after the start button is pressed to move the first and second running member 33 and 34. Then, a light is emitted from a light source, and the first running member 33 reflects the light reflected from a surface of the original document toward the second running member 34. The light is further reflected by a mirror of the second running member 34 and input in the reading sensor 36 via the imaging lens 35. Accordingly, the original document is read.

Further, when the start switch is pressed, a drive motor (not illustrated) rotates one of the support rollers 14, 15, and 16, and the other two of the support rollers 14, 15, and 16 are rotated along with rotation of the one of the support rollers 14, 15, and 16. Accordingly, the intermediate transfer member 210 is rotated. At the same time, the image carrying members 40Y, 40C, 40M, and 40K are rotated in the image forming units 18Y, 18C, 18M, and 18K, so that single-color images of black, yellow, magenta, and cyan colors are formed on the respective image carrying members 40Y, 40C, 40M, and 40K. Then, as the intermediate transfer member 210 rotates, the single-color images are sequentially transferred to the intermediate transfer member 210 to form a composite color image thereon.

Furthermore, when the start switch is pressed, one of the sheet-feeding rollers 42*a* to 42*c* is selectively rotated, and one sheet of the recording medium is pulled out from one of the sheet cassettes 44*a* and 44*b* in the paper bank 43. The recording medium is separated from remaining sheets of the recording medium by one of the separation roller pairs 45*b* and 45*c* and conveyed to the sheet path 46. The recording medium is conveyed by the conveyance rollers 47*a* to 47*d*, guided to the sheet path 48, and impacts the registration roller pair 49 to be stopped. Alternatively, the sheet-feeding roller 50 is rotated to pull out a recording medium from the manual sheet-feeding tray 51. The recording medium is separated from remaining sheets of the recording medium and conveyed to the manual sheet path 53. Then, the recording medium impacts the registration roller pair 49 and stopped.

The registration roller pair 49 is rotated at an appropriate time to align the composite color image carried on the intermediate transfer member 210, and the recording medium is sent to a nip formed between the intermediate transfer member 210 and the second transfer device 22. The recording medium is then subjected to a transfer operation at the second transfer device 22. Accordingly, a color image is formed on the recording medium.

Thereafter, the recording medium is conveyed by the second transfer belt 24 to the fixing device 25. The recording medium is applied with heat and pressure at the fixing device 25, and the color image is fixed on the recording medium. The recording medium is then guided by the switching claw 55 and conveyed and discharged by the discharge roller pair 56 to be stacked on the discharge tray 57. Toner remaining on the intermediate transfer member 210 is removed by the intermediate transfer member cleaning device 17 after the toner image is transferred from the intermediate transfer member 210 to the recording medium. Accordingly, the intermediate transfer member 210 is prepared for the next image forming operation performed by the tandem image forming mechanism 20.

Figure 2:
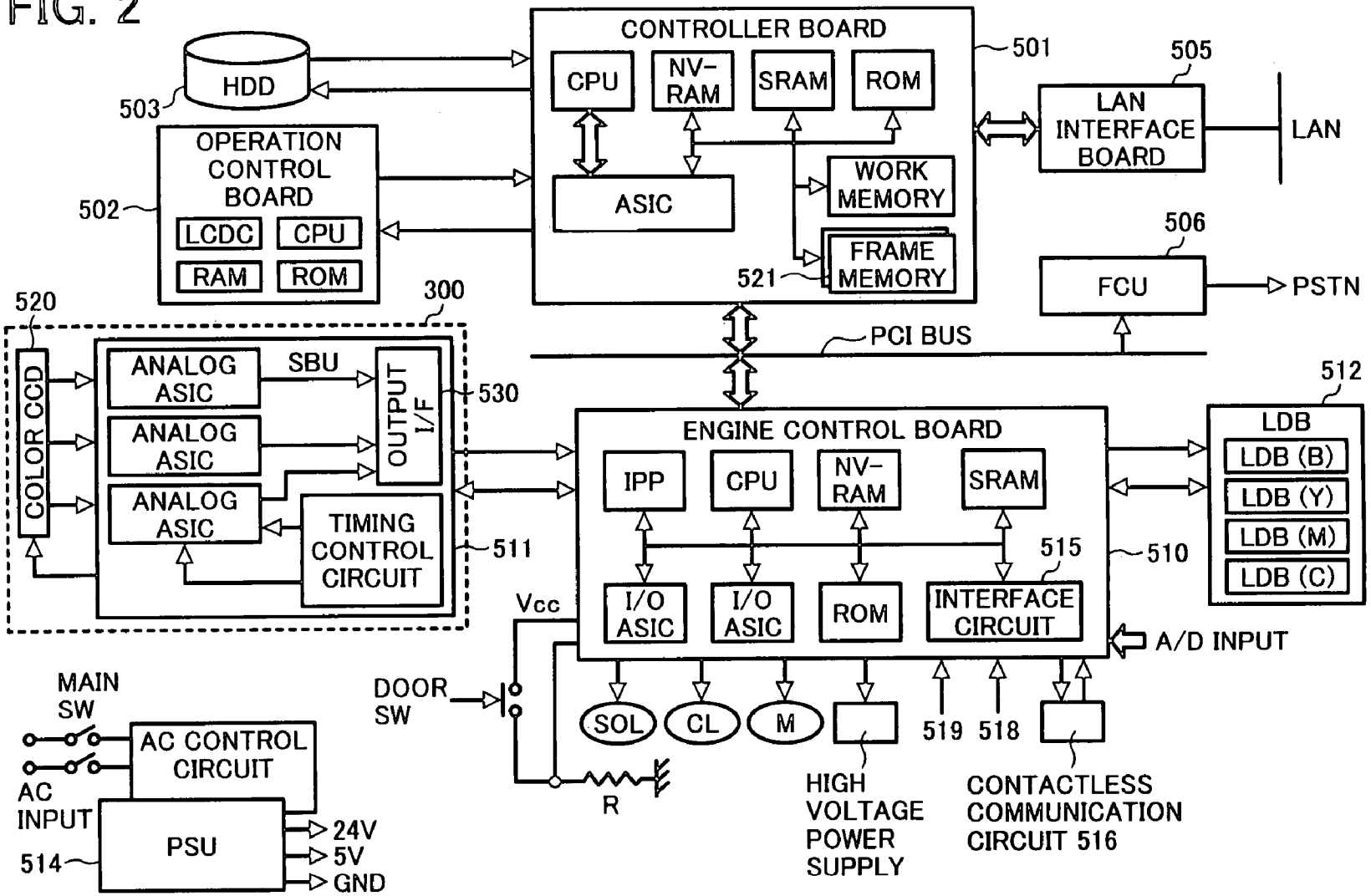
FIG. 2 is a block diagram of a control unit of the image forming apparatus shown in FIG. 1.

FIG. 2 is a block diagram illustrating a part of an electrical circuit of the image forming apparatus 100. In FIG. 2, a controller board 501 includes a plurality of application functions such as scanner application, facsimile application, printer application, and copy application, and controls the entire system of the image forming apparatus 100. The controller board 501 shown in FIG. 2 includes a CPU (central processing unit), a ROM (read only memory), a SRAM (static random access memory), a frame memory, a work memory, an NV-RAM (nonvolatile random access memory), an ASIC (application specific integrated circuit), and I/C (interface) circuits thereof. The ROM controls a system controller board. The SRAM serves as a work memory used by the CPU. The NV-RAM has a back-up function of the SRAM and includes a time-counter and a Lithium battery. The ASIC controls a system bus of the controller board 501, the frame memory, and peripheral devices of the CPU such as FIFO (first-in first-out) memory. Further, the controller board 501 is connected to an operation unit control board 502 of the image forming apparatus 100 and an HDD (hard disk drive) 503 which records image data.

The operation unit control board 502 includes a CPU, a RAM, a ROM, an LCD (liquid crystal display), and an ASIC (LCDC:LCD controller). The operation unit control board 502 controls an input operation performed by a user for setting the system through operation of a panel of the image forming apparatus 100, and an display operation of displaying setting contents or a state of the system to the user. The RAM serves as a work memory used by the CPU. A control program of the operation unit control board 502 is written to the ROM which controls a reading operation of reading inputs in the operation unit control board 502 and an output operation of outputting data to be displayed. The LCD displays the setting contents or the state of the system. The ASIC (LCDC) controls a key input operation.

The HDD 503 is used as an application database which stores an application program of the system and information of device energization of an image forming processing device of a printer. Further, the HDD 503 is used as an image database which stores image data of the read image or written image and document data. The HDD 503 is connected to the controller board 501 by a physical I/F, an electrical I/F, and an I/F in conformity to ATA/ATAPI-4 (advance technology attachment/advance technology attachment packet interface-4).

The controller board 501 is connected to a LAN (local area network) I/F board 505. Communication with a management system is established via the LAN I/F board 505. The LAN I/F board 505 is a communication I/F board communicating between an in-house LAN (e.g., Internet) and a controller. The LAN I/F board 505 is connected by a standard communication I/F such as a PHY (physical layer) chip I/F and a 12C bus 1/F.

Further, the controller board 501 is connected to a general PCI (peripheral component interconnect) bus which is connected to a FCU (facsimile control unit) 506. The PCI bus is an image data and control command bus which transfers image data and a control command by time division.

The PCI bus is also connected to an engine control board 510. The engine control board 510 is connected to the controller board 501 via the PCI bus. The engine control board 510 mainly controls image formation performed by the image forming apparatus 100. The engine control board 510 includes a CPU, an IPP (imaging photopolarimeter), a ROM, an SRAM, and an NV-RAM. The IPP performs imaging processing, serving as programmable calculating device. The ROM includes a program necessary for controlling a copying operation and a printing-out operation. The SRAM is used for controlling the ROM. The NV-RAM includes an SRAM and a memory for detecting a power-off of the image forming apparatus 100 and storing a detected signal in an EEPROM. The engine control board 510 further includes a serial I/F circuit for exchanging signals with the CPU for other control operation, and an I/O (inboard-outboard) ASICs for controlling I/Os (e.g., a counter, a fan, a solenoid, and a motor) which are arranged near the attachment positions of the engine control board 510.

Further, the engine control board 510 is connected to an SBU board 511, an LDB board 512, a contactless communication circuit 516, a toner-end sensor 518, and an image carrying member rotation detection signal 519. The SBU board 511 reads a copy document (image data). The LDB board 512 writes the image data onto the image carrying member 40. The contactless communication circuit 516 communicates with an IC (integrated circuit) tag attached to the process cartridge 1.

The SBU board 511 includes analog ASICs, a CCD (charge-coupled device), and a circuit for generating a timing of driving the analog ASICs.

The electric circuit of the image forming apparatus 100 illustrated in FIG. 2 further includes a PSU (power supply unit) 514 which supplies power for controlling the image forming apparatus. The PSU 514 receives commercial power from a main SW (switch).

A control operation of the image formation is described. An original document is set to the scanner 300 which includes the color CCD 520 and the SBU board 511, and the original document is optically read. Then, a document illuminating light source (not illustrated) included in the scanner 300 scans the original document by applying a light to the original document. A light reflected from the original document is photoelectrically converted by the color CCD 520 to generate an image signal. The color CCD 520 includes three line color CCDs, and generates R, G, and B image signals having EVENch/ODDch. The R, G, and B image signals are input to the corresponding analog ASICs of the SBU board 511, respectively. The R, G, and B image signals output from the three line color CCDs are sampling-held by a sampling-holding circuit in the analog ASICs and subjected to analog-to-digital conversion to be converted into data signals. Further, the analog ASICs for the R, G, and B image signals perform shading correction and send the digital signals to the IPP of the engine control board 510 via an image data bus of an output I/F 530. The IPP corrects image data received from the SBU board 511 by correcting the digital signals deteriorated due to quantization to optical signals and digital signals (i.e., signal deterioration in a scanner system). The corrected image data is written to the frame memory of the controller board 501 via an image data bus of the PCI bus.

Write signals of black (B), yellow (Y), cyan (C), and magenta (M) colors output from the work memory of the controller board 501 are input to LDBs (LD write circuit boards) for B, Y, M, and C in the LDB board 512. The LDBs control LD current (i.e., LD current modulation control), output LDs (laser diodes) of the respective colors B, Y, M, and C, and write the image data on the surfaces of the respective image carrying members with laser beams.

Figure 3:
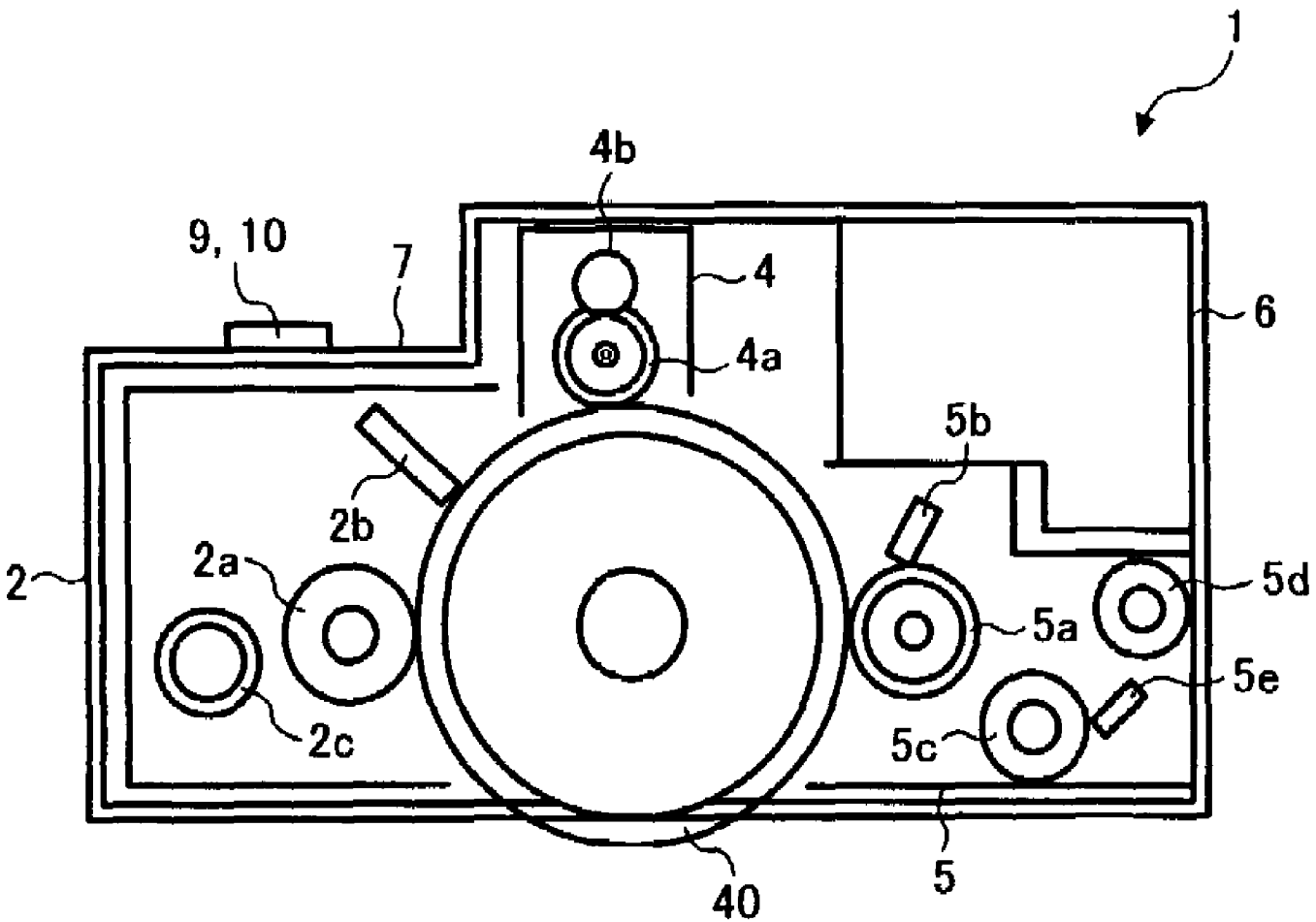
FIG. 3 is a sectional view of a process cartridge used in the image forming apparatus shown in FIG. 1.

The process cartridge 1 is described with reference to FIG. 3 which is a sectional view of the process cartridge 1. The process cartridge 1 includes the housing 7, the image carrying member 40, the image carrying member cleaning device 2, the charging device 4, the development device 5, and a toner container 6. The development device 5 and the toner container 6 form a development module. The image carrying member 40, the image carrying member cleaning device 2, the charging device 4, the development device 5, and the toner container 6 are provided in the housing 7 to be separately detached from and attached to the housing 7 for replacement. The housing 7 is also provided with a memory tag 9 or an IC chip 10 which has a NV—(nonvolatile) memory 11 (illustrated in FIGS. 8 and 9).

The image carrying member cleaning device 2 includes a cleaning brush roller 2*a*, a cleaning blade 2*b*, and a waste toner collecting coil 2*c*. The cleaning brush roller 2*a* removes the toner remaining on a surface of image carrying member 40. The charging unit 4 includes a charging roller 4*a*, and a charging brush roller 4*b* which cleans the charging roller 4*a*. The development device 5 includes a development roller 5*a*, a doctor blade 5*b*, two conveyance screws 5*c* and 5*d*, a T sensor 5*e*, an air pump (not illustrated), and a toner-end detection sensor 518 (illustrated in FIG. 2). The development roller 5*a* causes toner to adhere to a latent image formed on the image carrying member 40. The doctor blade 5*b* controls an amount of a developing agent adhered to the development roller 5*a*. The two conveying screws 5*c* and 5*d* mix and convey the developing agent to the development roller 5*a*. The T sensor 5*e* performs a toner density detection operation of detecting density of toner contained in the developing agent. The air pump conveys the toner from the toner container 6. The toner-end detection sensor 518 detects when the toner supply is exhausted (i.e., toner-end). The process cartridge 1 further includes a drive source (not illustrated) which drives such devices as the image carrying member 40, and a detection device (not illustrated), which detects the number of rotations of the image carrying member 40.

Figure 4:
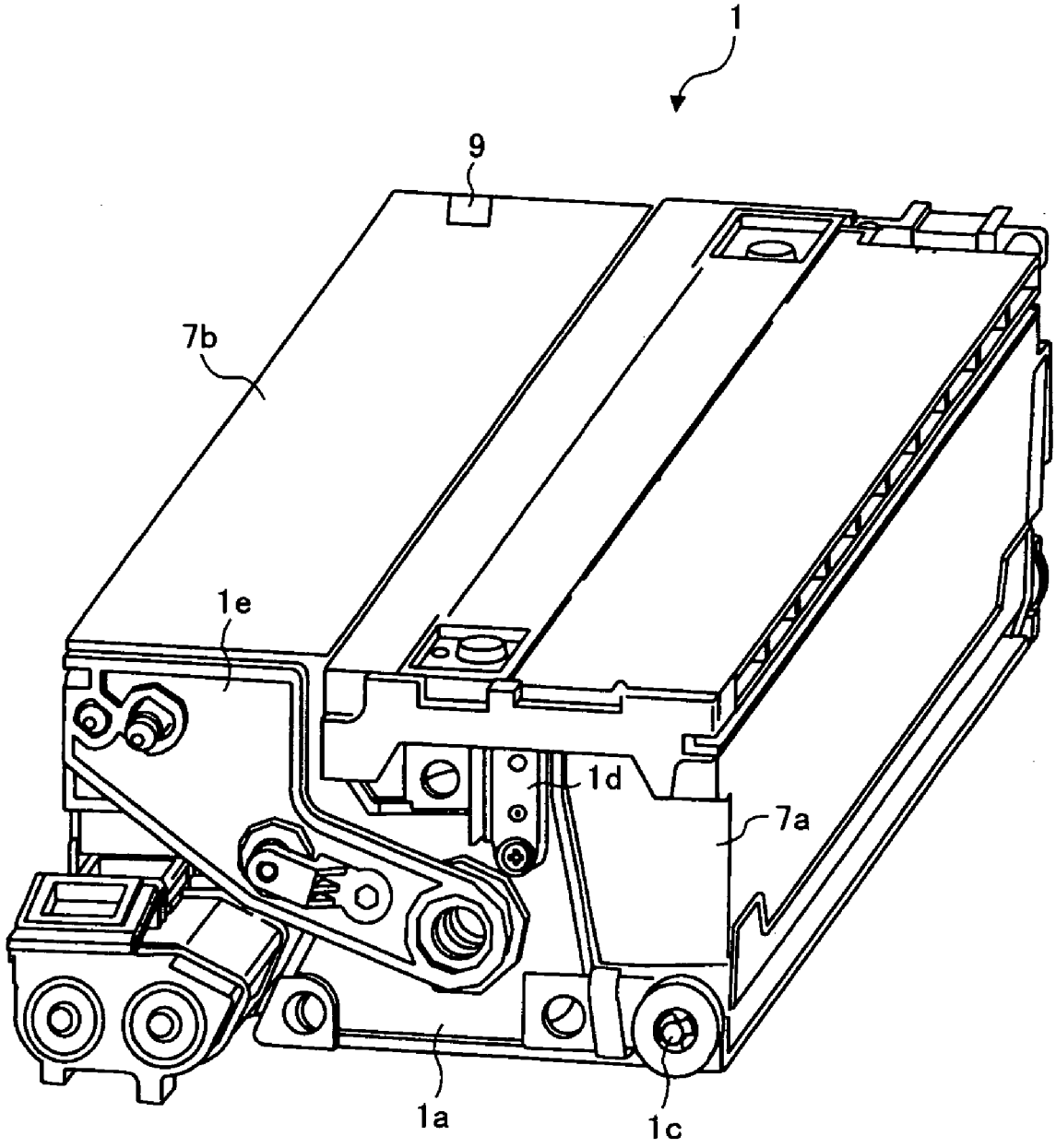
FIG. 4 is a perspective view of the process cartridge shown in FIG. 3.

FIG. 4 illustrates a perspective view of the process cartridge 1. The process cartridge 1 includes a front side plate 1*a* provided on a front side in the figure for supporting the image carrying member 40, and a back side plate 1*b* provided on a back side in the figure (illustrated in FIG. 6A). The process cartridge 1 further includes, on a right side in the figure, a first holding member 7*a* which is rotatably attached to the front side plate 1*a* and the back side plate 1*b* by a connection member 1*c*, and is fastened to the front side plate 1*a* and the back side plate 1*b* by positioning members 1*d*. The process cartridge 1 further includes, on a left side in the figure, a second holding member 7*b* which is attached to attaching members 1*e*. The attaching members 1*e* are attached to the front side plate 1*a* and the back side plate 1*b*. The image carrying member cleaning device 2 and the charging device 4 are attached to the first holding member 7*a*. Meanwhile, the development device 5 and the toner container 6 are attached to the second holding member 7*b*. The process cartridge 1 further includes, on a back side in the figure, the memory tag 9 or the IC chip 10 having the nonvolatile memory 11. The NV-memory 11 stores data of the process cartridge 1 and the devices included in the process cartridge 1. The data recorded in the NV-memory 11 is exchanged with the image forming apparatus 100.

Figure 5:
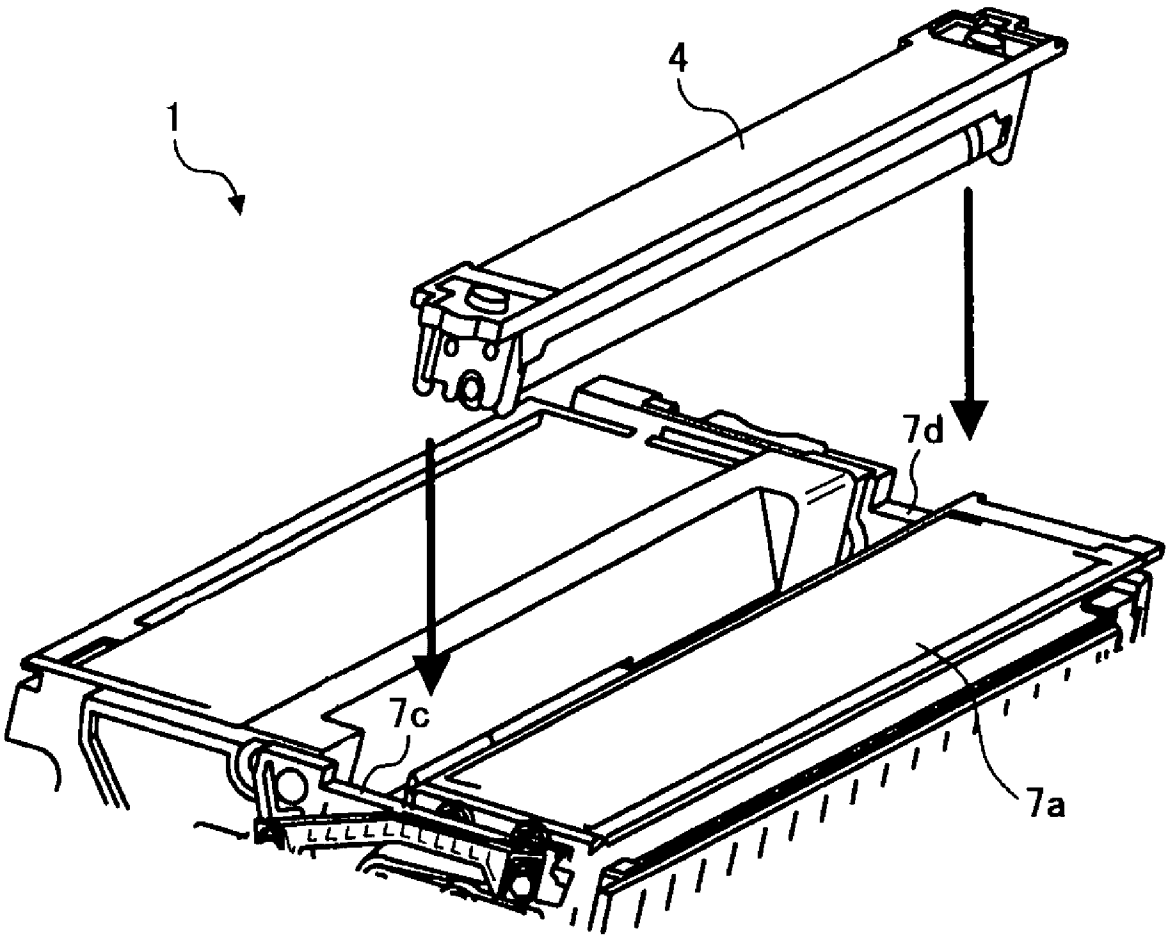
FIG. 5 is a perspective view of relevant parts of the process cartridge shown in FIG. 4, wherein a charging device is attached to the process cartridge.

FIG. 5 is a schematic perspective view of parts of the process cartridge 1, illustrating attachment of the charging device 4 to the process cartridge 1. The charging device 4 is inserted in charger attaching parts 7*c* and 7*d* provided on side plates of the first holding member 7*a* of the process cartridge 1, and fixed to the first holding member 7*a*. The charging device 4 can be detached with relative ease from the process cartridge 1 by unfastening the charging device 4 from the first holding member 7*a* and lifting the charging device 4 in an upward direction in the figure.

Figure 6A:
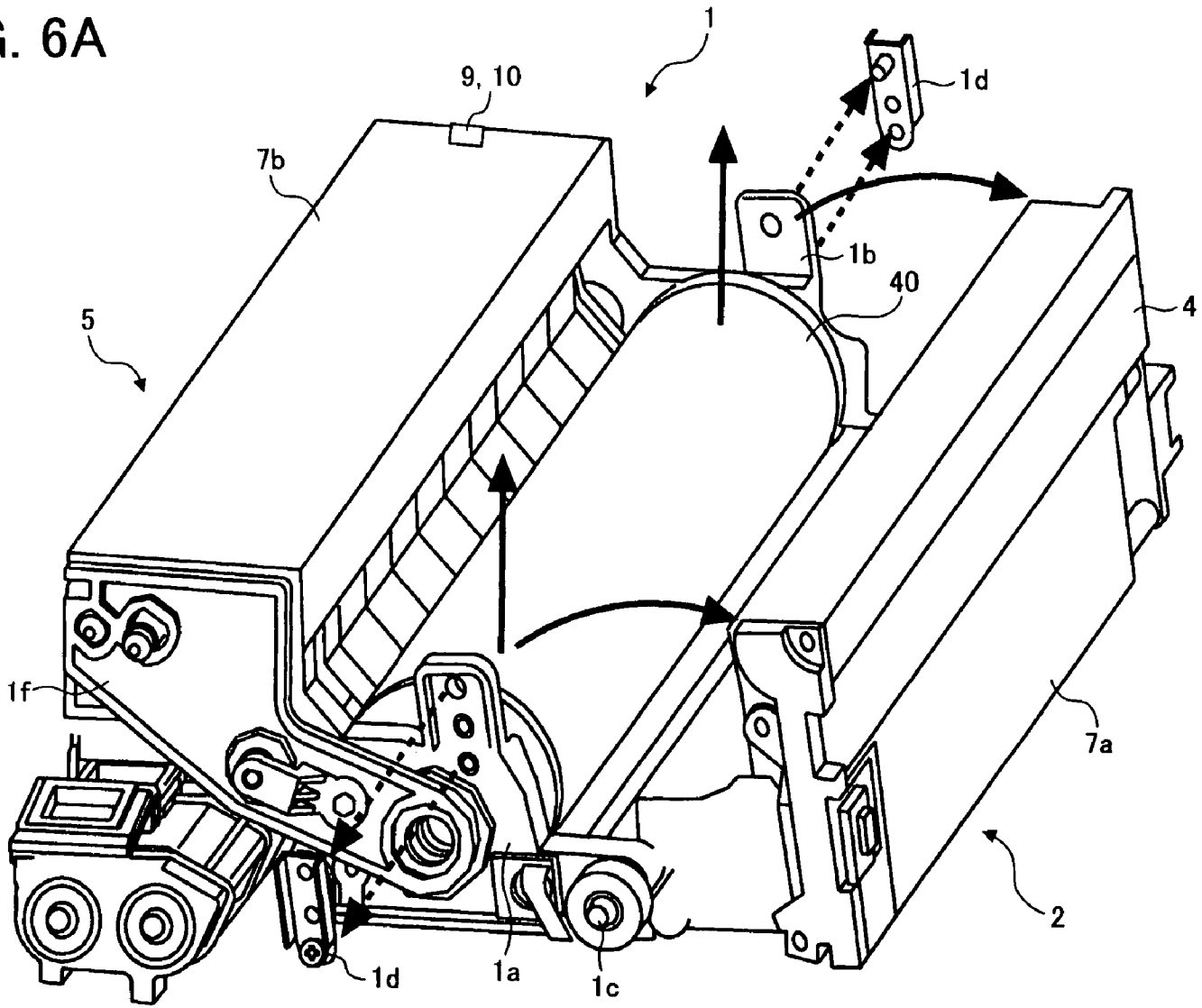
FIG. 6A is a perspective view of the process cartridge shown in FIG. 4, wherein an image carrying member is attached to the process cartridge.
Figure 6B:
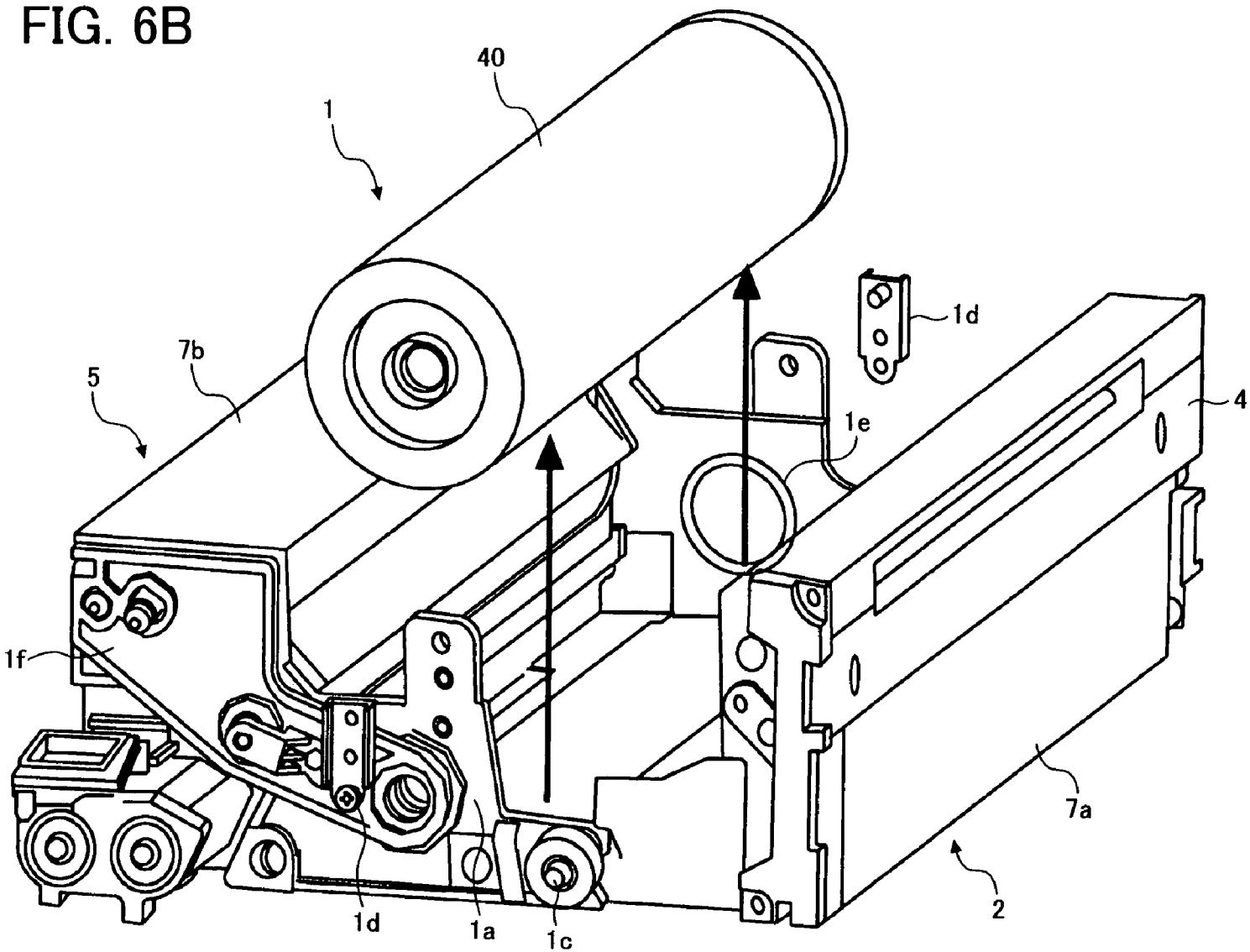
FIG. 6B is a perspective view of the process cartridge shown in FIG. 4, wherein the image carrying member is detached from the process cartridge.

Detachment of the image carrying member 40 from the process cartridge 1 is described with reference to FIGS. 6A and 6B. 6A is a perspective view of the process cartridge 1 wherein the image carrying member 40 is attached to the process cartridge 1, while FIG. 6B is a perspective view of the process cartridge 1 wherein the image carrying member 40 is detached from the process cartridge 1. In detaching the image carrying member 40 from the process cartridge 1, the positioning members 1*d* are removed so that the first holding member 7*a* is rotatable. Thereafter, the first holding member 7*a* is rotated, as illustrated in FIG. 6A. Since the image carrying member 40 is supported by the attaching members 1*e* provided on the front and back side plates 1*a* and 1*b*, the image carrying member 40 can be detached from the process cartridge 1 with relative ease by lifting the image carrying member 40 while pressing the image carrying member 40 to one of the front and back side plates 1*a* and 1*b*, as illustrated in FIG. 6B.

In attaching the image carrying member 40 to the process cartridge 1, on the other hand, the image carrying member 40 is attached to the attaching members 1*e* provided on the front and back side plates 1*a* and 1*b* while being pressed to one of the front and back side plates 1*a* and 1*b*. Thereafter, the first holding member 7*a* is rotated, and the positioning members 1*d* fasten the first holding member 7*a* to the front and back side plates 1*a* and 1*b*. In this way, the image carrying member 40 can be attached to the process cartridge 1 with relative ease.

The image carrying member cleaning device 2 can be detached with relative ease from the first holding member 7*a* by detaching a fastening member (not illustrated) which fixes the image carrying member cleaning device 2 to the first holding member 7*a*. Such components as the cleaning blade 2*b* and the cleaning brush roller 2*a* included in the image carrying member cleaning device 2 are detached from the image carrying member cleaning device 2 for replacement after the first holding member 7*a* is rotated as illustrated in FIG. 6A.

Figure 7A:
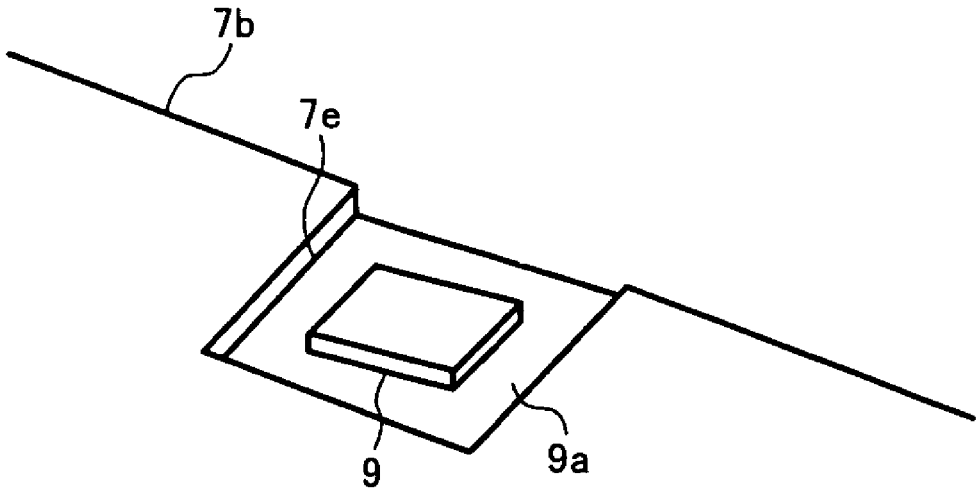
FIG. 7A is a perspective view of relevant parts of the process cartridge shown in FIG. 4, wherein a contactless memory tag is attached to the process cartridge.
Figure 7B:
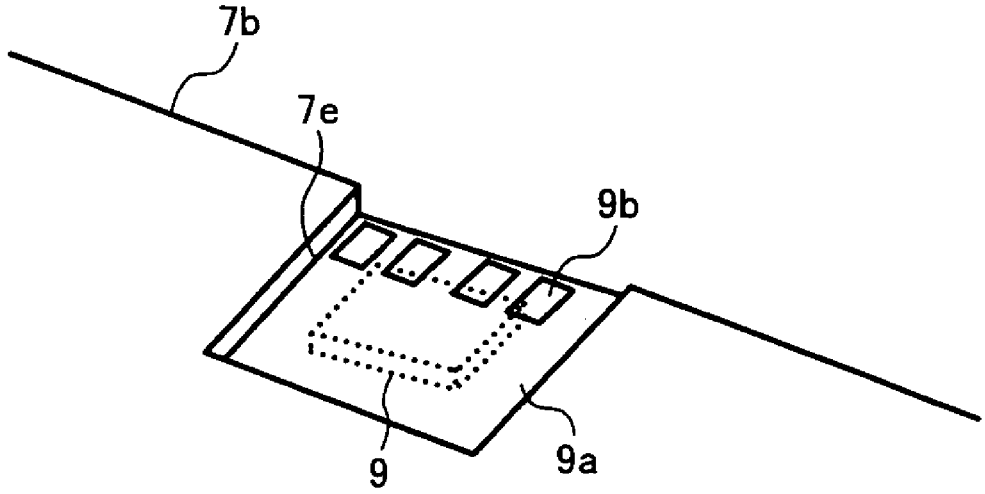
FIG. 7B is a perspective view of relevant parts of the process cartridge shown in FIG. 5, wherein a contact-type memory tag is attached to the process cartridge.

Attachment of the memory tag 9 to the process cartridge 1 is described with reference to FIGS. 7A and 7B. FIG. 7A is a perspective view of relevant parts of the process cartridge 1 wherein the memory tag 9, attached to the process cartridge 1, is a contactless-type. Meanwhile, FIG. 7B is a perspective view of relevant parts of the process cartridge 1 wherein the memory tag 9 attached to the process cartridge 1 is a contact-type. When the memory tag 9 is the contactless type as illustrated in FIG. 7A, a concave portion 7*e* is provided on the second holding member 7*b*. The contactless memory tag 9 is mounted on a printed circuit board 9*a* and attached to a surface of the concave portion 7*e*. When the memory tag 9 is the contact-type as illustrated in FIG. 7B, connection terminals 9*b* are arranged to a back surface of the printed circuit board 9*a*. The contactless memory tag 9 mounted on the printed circuit board 9*a* is attached to the concave portion 7*e* such that the connection terminals 9*b* face the surface of the concave portion 7*e*.

Figure 8:
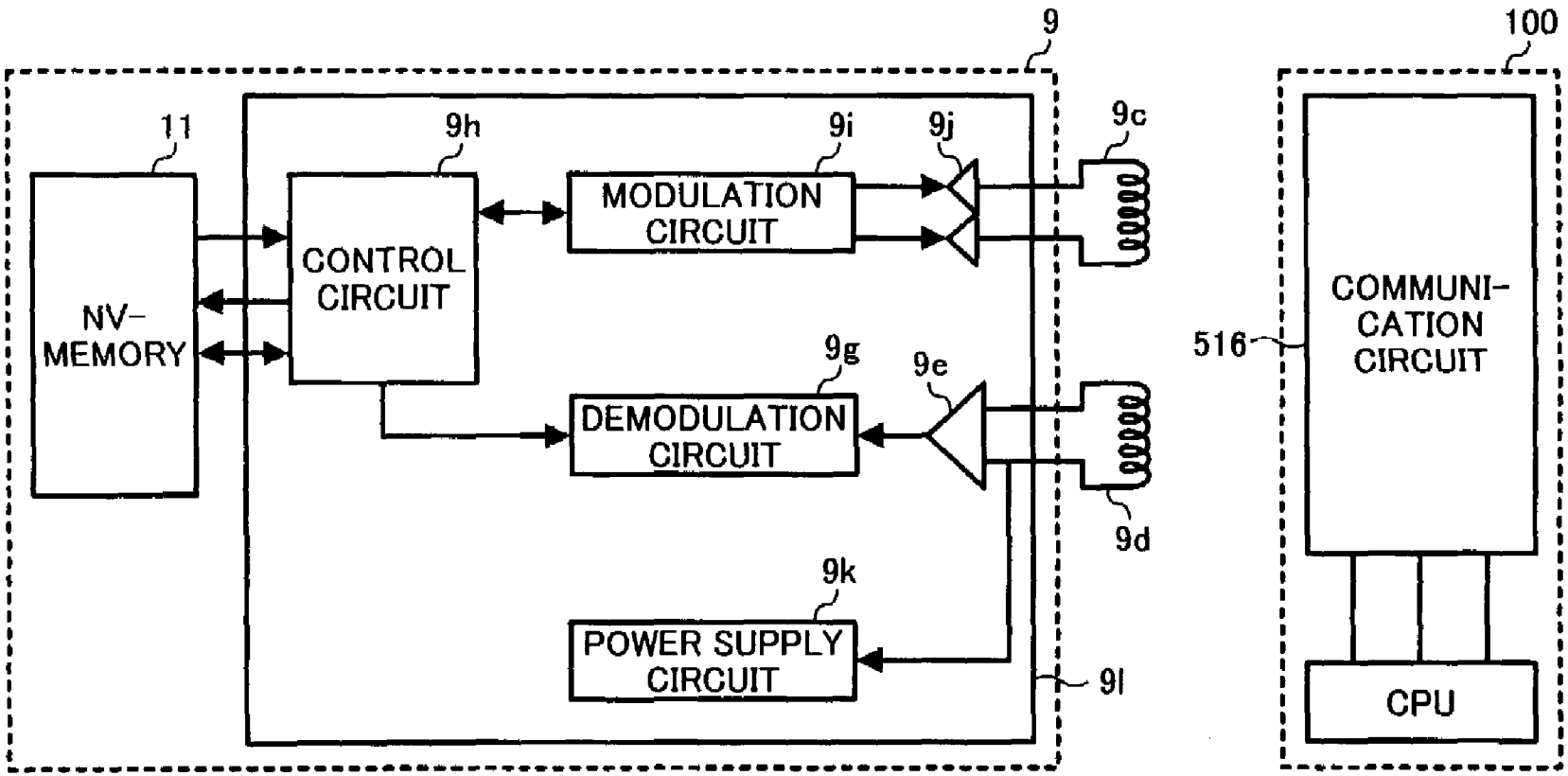
FIG. 8 is a block diagram illustrating a configuration of a memory tag attached to the process cartridge.

The memory tag 9 is described with reference to FIG. 8 which is a block diagram illustrating the memory tag 9. The memory tag 9 includes the NV-memory 11 which stores the data of the process cartridge 1 and the devices included in the process cartridge 1. The NV-memory 11 further stores information used for controlling the process cartridge 1. For example, the NV-memory 11 stores information used for reproducing the process cartridge 1, such as image forming conditions including an amount of exposure, an amount of charging, and a development bias voltage; product information including a lot number, a manufacture date, a product type, storage period, an identification number, and a manufacturer code of each of the devices such as the development device 5 and the charging device 4; information of a device or a component to be replaced in a reproduction operation; a replacement time (lifetime) of each component and device; the limit number of reproduction operations of each component and device; a code of each component and device detected to be worn out to the end of the lifetime thereof; information of an abnormal state detected by the T sensor; and information of abnormality detected in the image forming unit. The NV-memory 11 further stores reproduction information of the process cartridge 1 such as the number of reproduction operations, information of a replaced component or device, a toner supply amount, a toner supply timing, a toner type; lifetime information; and use history information used for lifetime detection. Such use history may include the use date, use time, use guarantee period, storage time, use start date, the number of copies produced, the number of roller rotations, the limit number of roller rotations, and a remaining toner amount.

The memory tag 9 includes a sending antenna 9*c* and a receiving antenna 9*d* for exchanging information with the image forming apparatus 100.

The memory tag 9 further includes a memory communication circuit 9*l* which sends data from the receiving antenna 9*d* to the NV-memory 11 and sends data from the NV-memory 11 to the sending antenna 9*c*. The memory communication circuit 9*l* includes an amplifying circuit 9*e*, a demodulation circuit 9*g*, a control circuit 9*h*, a modulation circuit 9*i*, sending drivers 9*j*, and a power supply circuit 9*k*. The amplifying circuit 9*e* amplifies a signal received by the receiving antenna 9*d*. The demodulation circuit 9*g* demodulates the amplified signal to a predetermined signal to be transferred. The control circuit 9*h* writes data on the NV-memory 11 and takes data from the NV-memory 11 based on the received signal. The modulation circuit 9*i* modulates the data in the NV-memory 11 to a predetermined signal to be transferred. The sending drivers 9*j* send a sending signal to the sending antenna 9*c*. The power supply circuit 9*k* supplies power for rectifying electromagnetic waves of the receiving antenna 9*d*.

The image forming apparatus 100 includes a CPU and the contactless communication circuit 516. The CPU is connected to the contactless communication circuit 516 via a serial I/F so that signals are exchanged between the CPU and the contactless communication circuit 516 via the serial I/F. The contactless communication circuit 516 and the memory communication circuit 9*l* share a common configuration.

Contactless communication between the image forming apparatus 100 and the memory tag 9 of the process cartridge 1 is performed as follows. First, a signal output from the CPU of the image forming apparatus 100 is modulated by the contactless communication circuit 516, and a sending signal is sent from a sending antenna (not illustrated) of the image forming apparatus 100. The signal sent from the sending antenna of the image forming apparatus 100 is received by the receiving antenna 9*d* of the memory tag 9. In this case, power is supplied to the receiving antenna 9*d* from the power supply circuit 9*k*, so that the electromagnetic waves are rectified. The received signal is amplified by the amplifying circuit 9*e* and demodulated to a predetermined signal by the demodulation circuit 9*g*. The signal demodulated to the predetermined signal is sent to the control circuit 9*h*, which controls, for example, data writing to the NV-memory 1I based on the predetermined signal. If the data sent from the image forming apparatus 100 is a signal requesting data stored in the NV-memory 11 to be sent, the control circuit 9*h* reads necessary data from the NV-memory 11 and sends the data to the modulation circuit 9*i*. The sent data is modulated to a predetermined signal by the modulation circuit 9*i* and sent to the sending antenna 9*c*. The predetermined signal sent to the sending antenna 9*c* is output from the sending antenna 9*c* and received by a receiving antenna (not illustrated) of the image forming apparatus 100. Then, the signal received by the receiving antenna of the image forming apparatus 100 is modulated by a modulation circuit (not illustrated) of the image forming apparatus 100 and sent to the CPU of the image forming apparatus 100. In this way, the data is sent from the NV-memory 11 to the CPU of the image forming apparatus 100.

The memory tag 9 described above is a contactless-type memory tag. Alternatively, the memory tag 9 may be a contact-type memory tag. In a case of the contact-type memory tag, the sending and receiving antennas 9*c* and 9*d* are replaced by the connection terminals 9*b*, and other parts of the configuration are common between the contactless type memory tag and the contact-type memory tag.

The IC chip 10 is described with reference to FIG. 9. The IC chip 10 includes a CPU 10*a* and the NV-memory 11. In comparison between data stored in the NV-memory 111 and calculation using the data stored in the NV-memory 11, the memory tag 9 needs to communicate with the image forming apparatus 100 so that the CPU of the image forming apparatus 100 performs the data comparison and calculation. Meanwhile, the IC chip 10 includes the CPU 10*a* as well as the NV-memory 11. Thus, the IC chip 10 can use its built-in CPU 10*a* to perform the comparison between data stored in the NV-memory 111 and the calculation using the data stored in the NV-memory 11.

Figure 9:
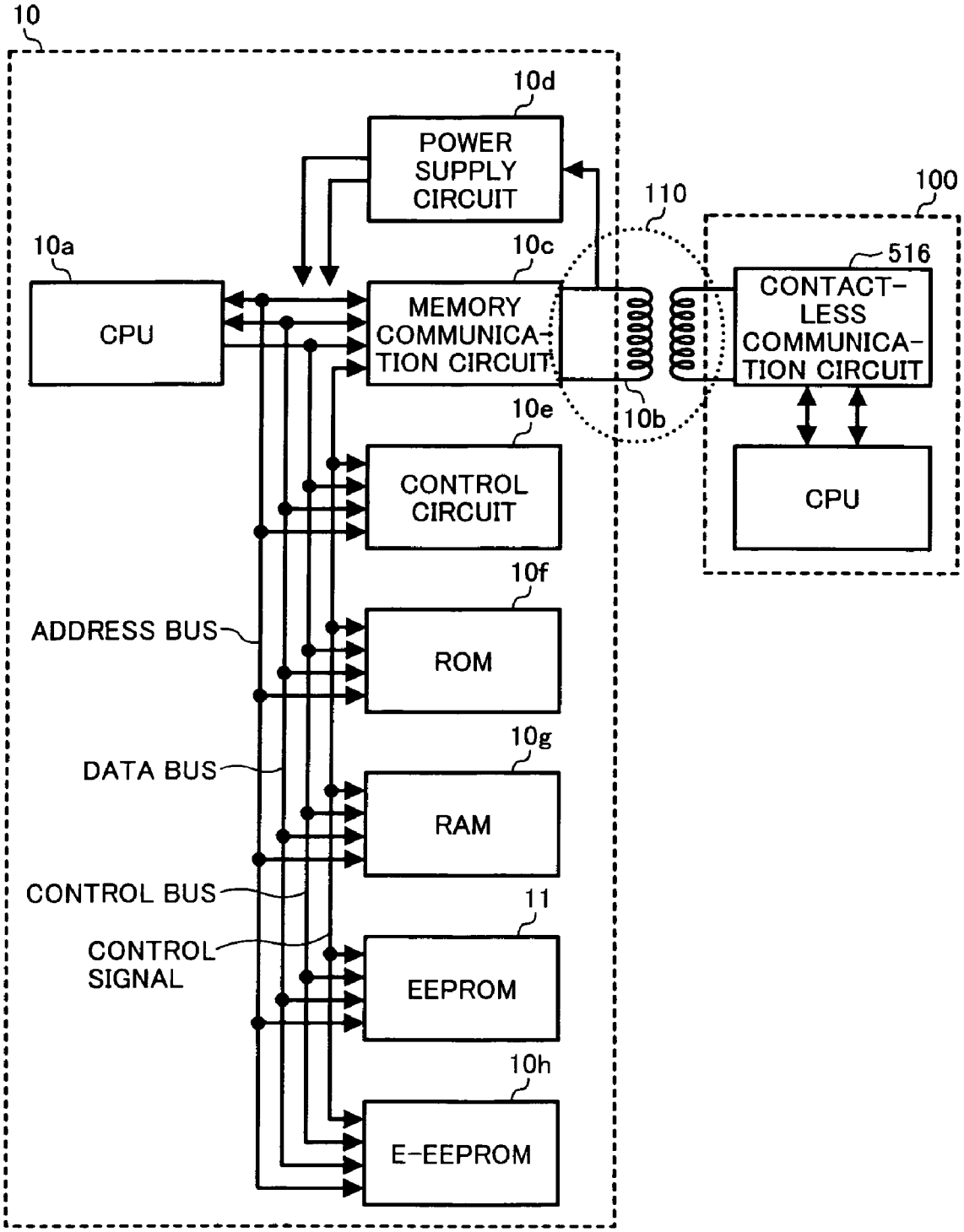
FIG. 9 is a block diagram illustrating a configuration of an IC chip attached to the process cartridge.

FIG. 9 is a block diagram of the IC chip 10. As described above, the IC chip 10 includes the CPU 10*a* and the NV-memory 11. The IC chip 10 further includes a sending and receiving antenna 10*b*, a memory communication circuit 10*c*, a power supply circuit 10*d*, a control circuit 10*e*, a ROM 10*f*, a RAM 10*g*, the NV-memory (EEPROM) 11, and an E-EEPROM 10*h*. The sending and receiving antenna 10*b* establishes contactless communication with the contactless communication circuit 516. The power supply circuit 10*d* supplies power for rectifying the electromagnetic waves of the sending and receiving antenna 10*b*. The control circuit 10*e* controls the inner components of the IC chip 10. The ROM 10*f* serves as a program memory. The RAM 10*g* serves as a work memory for executing programs. The E-EEPROM 10*h* stores a specific command to be written to the NV-memory 11.

The CPU 10*a* communicates with external devices by using a ROM stored therein and reads data out and writes data in the NV-memory 11 in response to an external command. The CPU 10*a* is provided with an I/O port to access outputs from the toner-end detection sensor 518 and a rotation signal of the image carrying member 40.

Contactless communication between the image forming apparatus 100 and the IC chip 10 of the process cartridge 1 is performed as follows. A signal output from the CPU of the image forming apparatus 100 is first modulated to a predetermined signal by the contactless communication circuit 516 and sent to a sending and receiving antenna 110. The signal sent from the sending and receiving antenna 110 is received by the sending and receiving antenna 10*b* of the IC chip 10. The signal is demodulated by the memory communication circuit 10*c* from the predetermined signal to a parallel signal and sent to the CPU 10*a*. Based on the signal sent from the image forming apparatus 100, the CPU 10*a* reads data from the NV-memory 11 and performs calculations based on a predetermined program stored in the ROM 10*f*. A result of the calculation is written to the NV-memory 11. The calculation result is also sent from the CPU 10*a* of the IC chip 10 to the image forming apparatus 100 by memory communication circuit 10*c*.

Figure 10:
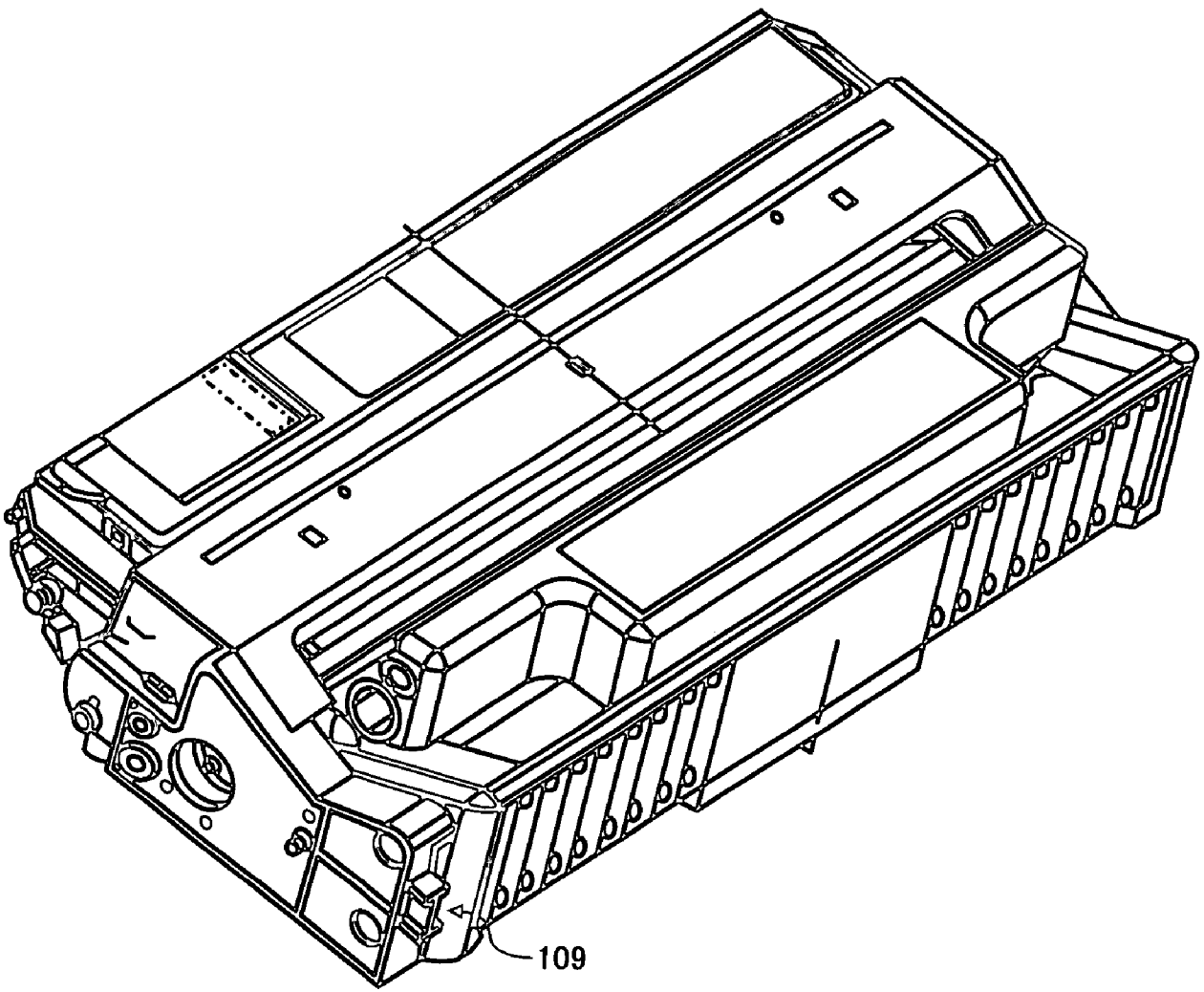
FIG. 10 is a perspective view of the process cartridge to which the IC chip is attached.

As illustrated in FIG. 7A, the IC chip 10 may be attached to the concave portion 7*e* of the second holding member 7*b*, as in the case of the memory tag 9. Alternatively, as illustrated in FIG. 10, the IC chip 10 may be detachably provided to an IC chip socket 109 provided on the process cartridge 1.

Description is made on detection of the lifetime of a replaceable member included in the process cartridge 1 by using the memory tag 9 of the process cartridge 1. According to the present embodiment, the lifetime of the process cartridge 1 is determined based on such factors as the operation time, the user limit, the number of copies produced, and the number of roller rotations.

Figure 11:
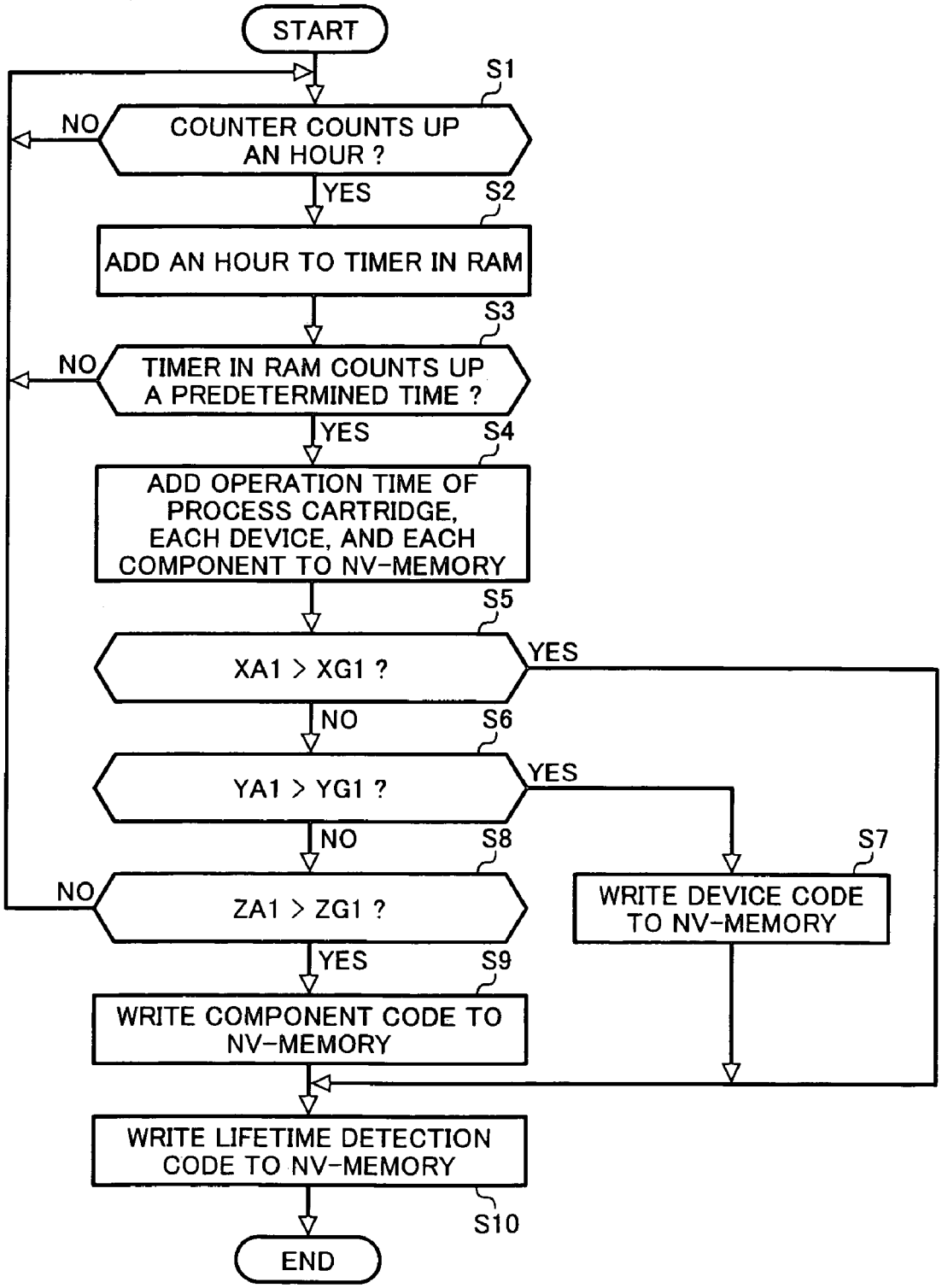
FIG. 11 is a flowchart of an operation time check operation.

Determination of information about the lifetime of the process cartridge 1 based on the operation time is described. FIG. 11 is a flowchart illustrating an operation of detecting the lifetime of each of the devices and components included in the process cartridge 1 based on the operation time. It is first determined if a counter in an inner timer of the CPU included in the image forming apparatus 100 has counted one hour, for example (Step S1). If it is determined that the counter has not counted one hour (NO in Step S1), the Step S1 and its subsequent steps are repeated. If it is determined that the counter has counted one hour (YES in Step S1), one hour is added to counts of a counting timer of the RAM included in the image forming apparatus 100 (Step S2). It is then determined if the counting timer of the RAM has counted a predetermined time (Step S3). If it is determined that the counter has not counted the predetermined time (NO in Step S3), the Step S1 and its subsequent steps are repeated. The predetermined time may be arbitrarily set. If the predetermined time is set to one hour, for example, a use time of the process cartridge 1 or of each of the components and devices included in the process cartridge 1 can be known with relative accuracy. In this case, however, Step S4 and its subsequent steps are performed every hour, which is not efficient.

If the predetermined time is set to a daily average use time of the image forming apparatus 100, an error is caused to some degree in the use time of the process cartridge 1 or of each of the components and devices included in the process cartridge 1. The use guarantee time of the process cartridge 1 or of each of the components and devices included in the process cartridge 1 is set to a sufficiently long time. Therefore, such an error may be ignored. Further, if the predetermined time is thus set, the Step S4 and its subsequent steps are performed once a day, which is effective.

After the counting timer of the RAM has counted the predetermined time (YES in Step S3), communication with the memory tag 9 of the process cartridge 1 is established. Then, a cumulative operation time of the process cartridge 1 stored in the NV-memory 11 is read, and the CPU adds the predetermined time. The added cumulative operation time of the process cartridge 1 is written to the NV-memory 11. Similarly, the cumulative operation time of each of the components and devices included in the process cartridge 1 stored in the NV-memory 11 is read, the predetermined time is added, and the added cumulative operation time of the each of the components and devices included in the process cartridge 1 is written to the NV-memory 11 (Step S4). In this case, the operation time of the device or component which is detected to be at the end of its lifetime and thus replaced with a new one is reset in the reproduction operation, which is described later. Other components and devices determined not to be at the end of their lifetimes continue to be used without being replaced. If the cumulative operation time of each of the devices and components is not stored in the NV-memory 11, it is unknown how long the each of the components and devices which continue to be used without being replaced is operated. Therefore, the NV-memory 11 stores the cumulative operation time of each of the devices and components included in the process cartridge 1. Since the cumulative operation time is stored in the NV-memory 11, the cumulative operation time is not erased even when the power of the image forming apparatus 100 is turned off.

After the cumulative operation time is stored in the NV-memory 11, an operation guarantee time of the process cartridge 1 (XG1) stored in the NV-memory 111 and the cumulative operation time of the process cartridge 1 (XA1) are read, and the CPU compares the operation guarantee time with the cumulative operation time (Step S5). If it is determined based on the comparison that the cumulative operation time of the process cartridge 1 exceeds the operation guarantee time of the process cartridge 1, i.e., XA1>XG1 (YES in Step S5), the process cartridge 1 is determined to be at the end of its lifetime, and a lifetime detection code is written to the NV-memory 11 of the memory tag 9 (Step S10). The lifetime detection code is used for finding a factor by which the lifetime is detected, and different lifetime detection codes are assigned to respective factors, i.e., the operation time, the use limit, the number of copies produced, and the number of roller rotations. In the example described above, the lifetime detection code of the operation time is written to the NV-memory 11, and the lifetime detection operation based on the operation time ends.

If it is determined that the cumulative operation time of the process cartridge 1 has not exceeded the operation guarantee time of the process cartridge 1, i.e., XA1≦XG1 (NO in Step S5), the operation guarantee time of each of the devices included in the process cartridge 1 (YG1) stored in the NV-memory 11 and the cumulative operation time of the each of the devices (YA1) are read, and the CPU compares the operation guarantee time with the cumulative operation time (Step S6).

If it is determined, based on the comparison that the cumulative operation time of any of the devices included in the process cartridge 1 exceeds the operation guarantee time of the any of the devices, i.e., YA1>YG1 (YES in Step S6), a device code of the any of the devices determined to be at the end of its lifetime is written to the NV-memory 11 of the memory tag 9 (Step S7). Different device codes are assigned to the devices included in the process cartridge 1. If the operation time of the development device 5 exceeds the operation guarantee time of the development device 5, for example, the code of the development device 5 is written to the NV-memory 11. Thereafter, the lifetime detection code is written to the NV-memory 11 (Step S10) and the lifetime detection operation based on the operation time ends.

When it is determined, based on the comparison that the cumulative operation time of any of the devices included in the process cartridge 1 has not exceeded the operation guarantee time of the any of the devices, i.e., YA1≦YG1 (NO in Step S6), the operation guarantee time of each of the components included in the process cartridge 1 (ZG1) stored in the NV-memory 11 and the cumulative operation time of the each of the components (ZA1) are read, and the CPU compares the operation guarantee time with the cumulative operation time (Step S8). If it is determined, based on the comparison that the cumulative operation time of any of the components included in the process cartridge 1 has exceeded the operation guarantee time of the any of the components, i.e., ZA1>ZG1 (YES in Step S8), a component code of the components detected to be at the end of their lifetimes is written to the NV-memory 11 of the memory tag 9 (Step S9). Different component codes are assigned to the components included in the process cartridge 1, such as the cleaning blade 2*b* of the cleaning device 2 and the charging roller 4*a* of the charging device 4. After the component code is written to the NV-memory 11, the lifetime detection code is written to the NV-memory 11 (Step S10) and the lifetime detection operation based on the operation time ends.

If it is determined, based on the comparison that the cumulative operation time of any of the components included in the process cartridge 1 has not exceeded the operation guarantee time of the any of the components, i.e., ZA1≦ZG1 (NO in Step 8), the Step 1 and its subsequent steps are repeated.

Figure 12:
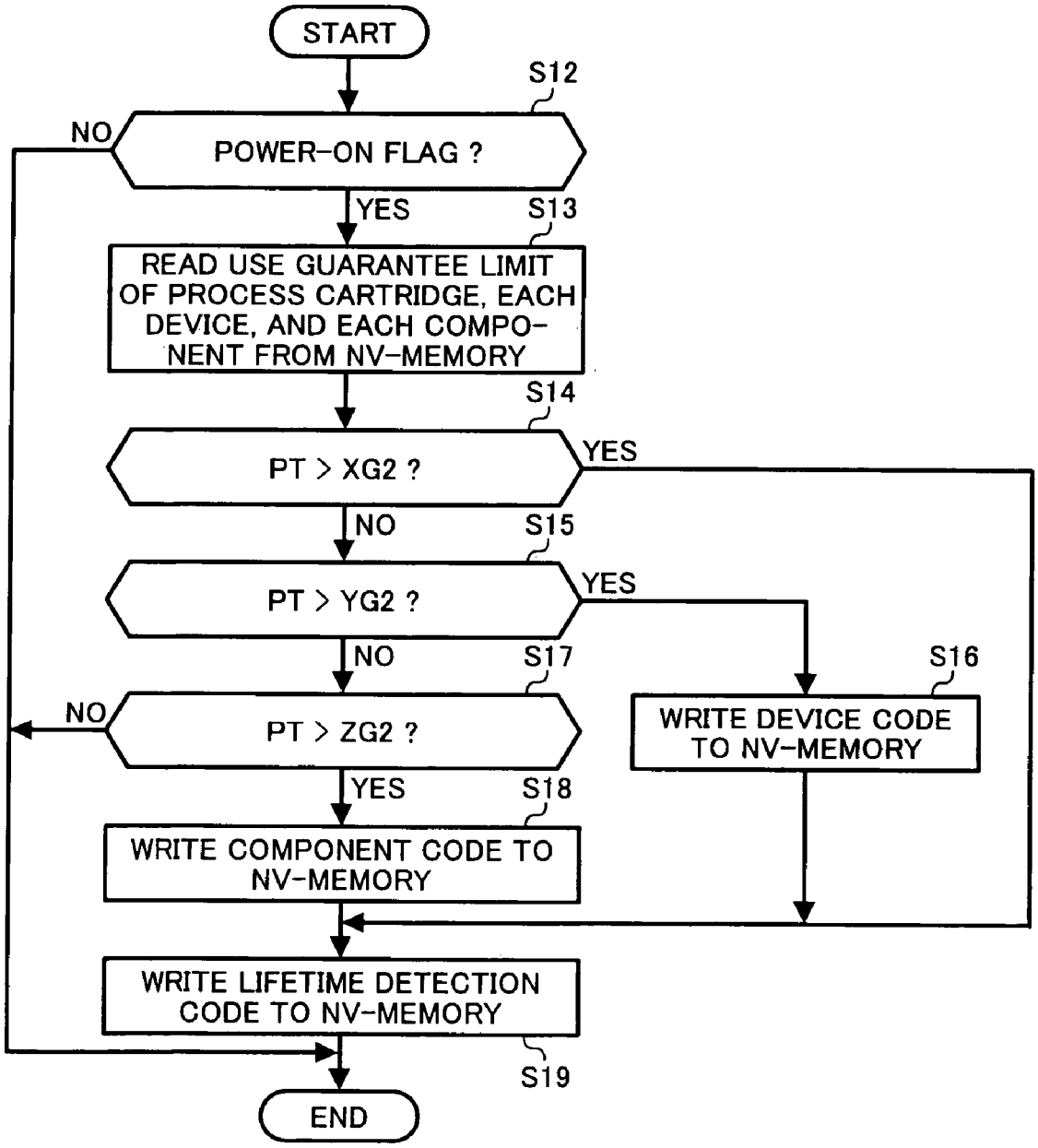
FIG. 12 is a flowchart of an use limit check operation.

With reference to FIG. 12, an operation of detecting the lifetime of the process cartridge 1 based on the use limit is described. FIG. 12 is a flowchart illustrating the operation of detecting the lifetime of the process cartridge 1 based on the use limit. This lifetime detection operation based on the use limit is performed upon power-on of the image forming apparatus 100. It is first checked if a power-on flag is set (Step S12). If the power-on flag is not set (NO in Step S12), the check operation of the use limit ends. If the power-on flag is set (YES in Step S12), communication with the image forming apparatus 100 is established, and a use guarantee limit date of the process cartridge 1 is read from the NV-memory 11. Similarly, the use guarantee limit date of each of the components and devices included in the process cartridge 1 is read from the NV-memory 11 (Step S13). Then, the CPU compares a present date (PT), i.e., year, month, and day, with the use guarantee limit date of the process cartridge 1 (XG2) (Step S14).

If it is determined, based on the comparison that the present date has passed the use guarantee limit date of the process cartridge 1, i.e., PT≦XG2 (YES in Step S14), the lifetime detection code is written to the NV-memory 11 (Step S19), and the lifetime detection operation based on the use limit ends. The lifetime detection code in this case indicates the use limit.

If it is determined, based on the comparison that the present date has not passed the use guarantee limit date of the process cartridge 1, i.e., PT≦XG2 (NO in Step S14), the present date is compared with the use guarantee limit date of each of the devices included in the process cartridge 1 (YG2) (Step S15). If it is determined, based on the comparison that the present date has passed the use guarantee limit date of any of the devices included in the process cartridge 1, i.e., PT>YG2 (YES in Step S15), a device code of the any of the devices detected to have passed its use guarantee limit date and thus at the end of its lifetime is written to the NV-memory 11 (Step S16). Thereafter, the lifetime detection code is written to the NV-memory 11 (Step S19) and the lifetime detection operation based on the use limit ends.

When it is determined, based on the comparison that the present date has not passed the use guarantee limit date of any of the devices included in the process cartridge 1, i.e., PT≦YG2 (NO in Step S15), the present date is compared with the use guarantee limit date of each of the components included in the process cartridge 1 (ZG2) (Step S17).

If it is determined, based on the comparison that the present date has passed the use guarantee limit date of the any of the components included in the process cartridge 1, i.e., PT>ZG2 (YES in Step S17), the component code of the any of the components detected to have passed its use guarantee limit date and thus at the end of its lifetime is written to the NV-memory 11 (Step S18). Then, the lifetime detection code is written to the NV-memory 11 (Step S19), and the lifetime detection operation based on the use limit ends. If it is determined based on the comparison that the present date has not passed the use guarantee limit date of any of the components included in the process cartridge 1, i.e., PT≦ZG2 (NO in Step S17), the check operation of the use limit ends.

Figure 13:
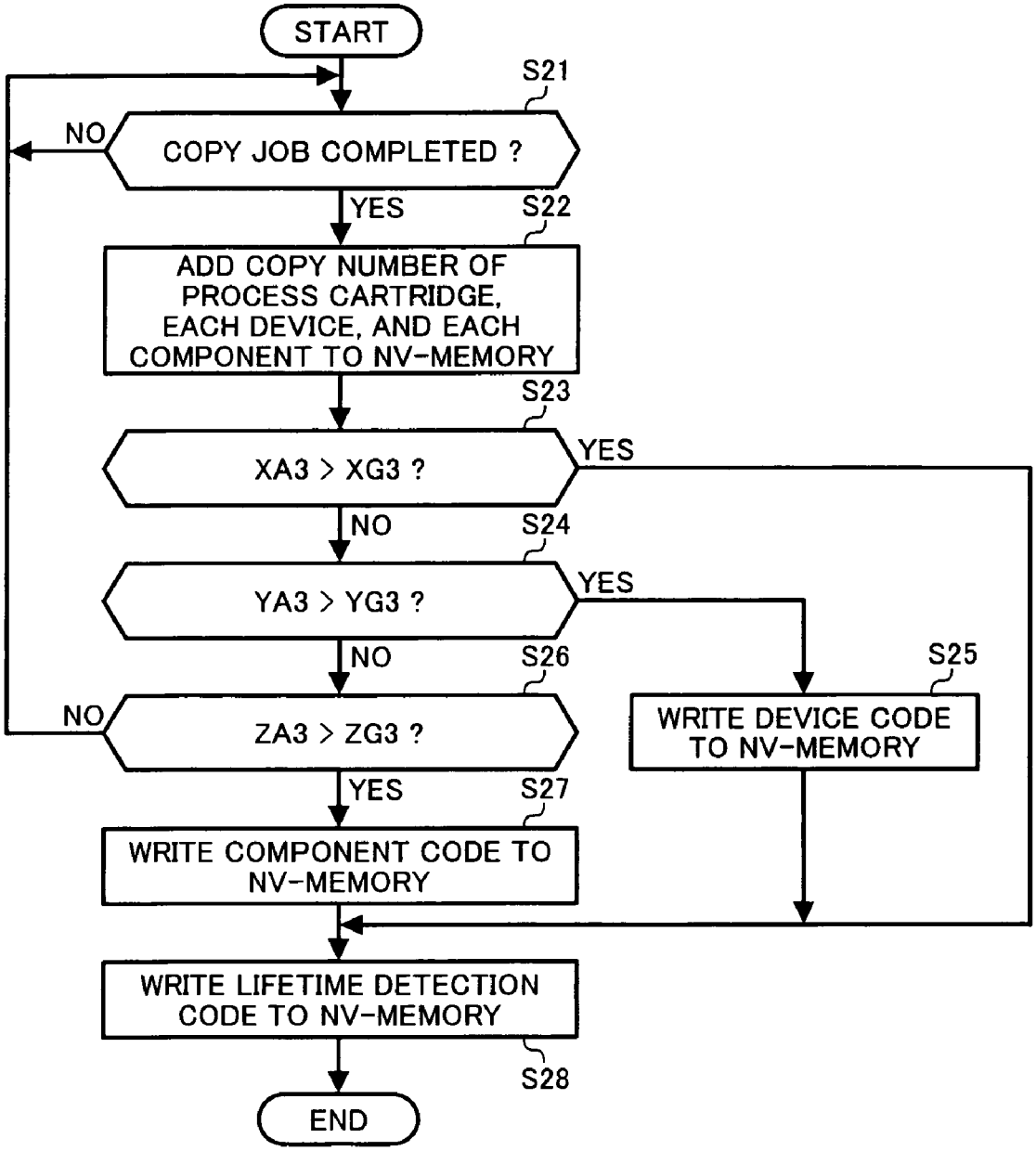
FIG. 13 is a flowchart of a copy number check operation.

With reference to FIG. 13, an operation of detecting the lifetime of the process cartridge 1 based on the number of copies is described. FIG. 13 is a flowchart illustrating the operation of detecting the lifetime of the process cartridge 1 based on the number of copies. It is first determined if a copying operation has ended (Step S21). If it is determined that the copying operation (i.e., copy job) has not ended (NO in Step S21), the Step 21 and its subsequent steps are performed. If it is determined that the copying operation has ended (YES in Step S21), communication with the NV-memory 11 is established. Then, a cumulative number of copies of the process cartridge 1 stored in the NV-memory 11 is read, and the CPU adds the number of copies.

The added cumulative number of copies of the process cartridge 1 is written to the NV-memory 11. Similarly, the cumulative number of copies of each of the components and devices included in the process cartridge 1 is read from the NV-memory 11, and the CPU adds the cumulative number of copies of the each of the components and devices. The added cumulative number of copies of the each of the components and devices is written to the NV-memory 11 (Step S22). The cumulative number of copies is set for the process cartridge 1 and for each of the devices and components included in the process cartridge 1 to find a use history of any of the devices and components included in the process cartridge 1 which continues to be used without being replaced even when other devices and components included in the process cartridge 1 are replaced.

After the cumulative number of copies of the process cartridge 1 and the cumulative number of copies of each of the devices and components included in the process cartridge 1 are stored in the NV-memory 11, a limit number of copies of the process cartridge 1 (XG3) stored in the NV-memory 11 and the cumulative number of copies of the process cartridge 1 (XA3) are read, and the CPU compares the limit number of copies of the process cartridge 1 with the cumulative number of copies of the process cartridge 1 (Step S23).

If it is determined, based on the comparison that the cumulative number of copies of the process cartridge 1 has exceeded the limit number of copies of the process cartridge 1, i.e., XA3>XG3 (YES in Step S23), it is determined that the process cartridge 1 is at the end of its lifetime, and the lifetime detection code is written to the NV-memory 11 (Step S28). The lifetime detection code in this case indicates the number of copies. After the lifetime detection code is written to the NV-memory 11, the lifetime detection operation based on the number of copies ends.

If it is determined, based on the comparison the cumulative number of copies of the process cartridge 1 has not exceeded the limit number of copies of the process cartridge 1, i.e., XA3≦XG3 (NO in Step S23), the cumulative number of copies of each of the devices included in the process cartridge 1 (YA3) stored in the NV-memory 11 and the limit number of copies of the each of the devices (YG3) are read, and the CPU compares the cumulative number of copies with the limit number of copies (Step S24).

If it is determined, based on the comparison that the cumulative number of copies of any of the devices included in the process cartridge 1 has exceeded the limit number of copies of the any of the devices, i.e., YA3>YG3 (YES in Step S24), the device code of the any of the devices detected to be at the end of its lifetime is written to the NV-memory 11 (Step S25). Then, the lifetime detection code is written to the NV-memory 11 (Step S28), and the lifetime detection operation based on the number of copies ends.

If it is determined, based on the comparison that the cumulative number of copies of any of the devices included in the process cartridge 1 has not exceeded the limit number of copies of the any of the devices, i.e., YA3≦YG3 (NO in Step S24), the cumulative number of copies of each of the components included in the process cartridge 1 (ZA3) stored in the NV-memory 11 and the limit number of copies of the each of the components (ZG3) are read, and the CPU compares the cumulative number of copies with the limit number of copies (Step S26). If it is determined, based on the comparison that the cumulative number of copies of any of the components included in the process cartridge 1 has exceed the limit number of copies of the any of the components, i.e., ZA3>ZG3 (YES in Step S26), the component code of the components detected to be at the end of their lifetimes is written to the NV-memory 11 (Step S27). Then, the lifetime detection code is written to the NV-memory 11 (Step S28), and the lifetime detection operation based on the number of copies ends.

If it is determined, based on the comparison that the cumulative number of copies of any of the components included in the process cartridge 1 has not exceeded the limit number of copies of the any of the components, i.e., ZA3≦ZG3 (NO in Step S26), the Step 1 and its subsequent steps are repeated.

In the above-described lifetime detection operation based on the operation time, the use limit, or the number of copies, the lifetime of the process cartridge 1 is first detected, and then the lifetime of each of the devices included in the process cartridge 1 is detected. Thereafter, the lifetime of each of the components included in the process cartridge 1 is detected. The order of lifetime detection, however, can be arbitrarily set. For example, the lifetime of each of the components included in the process cartridge 1 may be first detected, and the lifetime of the process cartridge 1 may be lastly detected. If the process cartridge 1 exclusively includes the housing 7 without including any component which is involved in the image forming operation, for example, the lifetime detection operation of the process cartridge 1 may be omitted. Alternatively, the lifetime of each of the devices or components included in the process cartridge 1 may be detected. Further, if the process cartridge 1 includes the IC chip 10 instead of the memory tag 9, the CPU 10*a* of the IC chip 10 can perform the lifetime detection operation by comparing the guarantee information such as the operation guarantee time, the use limit date, and the limit number of copies, with the operation information such as the cumulative operation time, the present date, and the cumulative number of copies.

Figure 14:
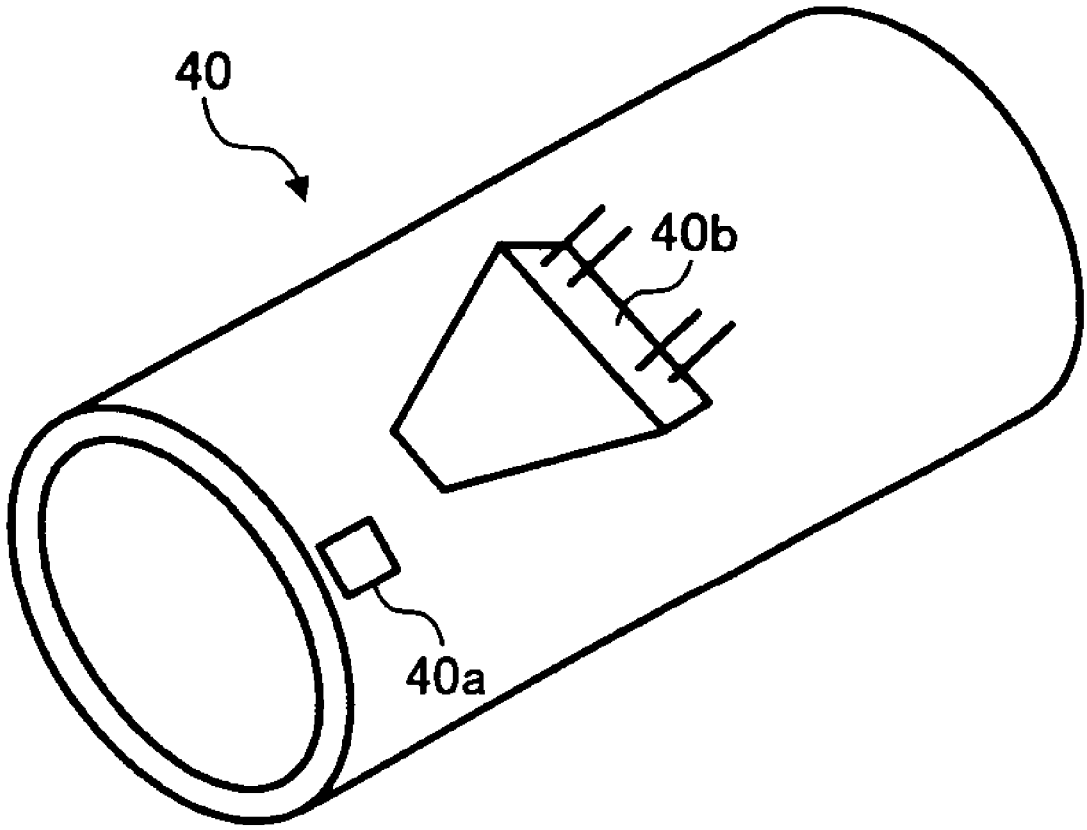
FIG. 14 is a schematic view of a rotation number detection mechanism of detection the rotation number of an image carrying member.

An operation of detecting the lifetime of the process cartridge 1 based on the number of rotations of the image carrying member 40 is described. This lifetime detection operation based on the number of rotations of the image carrying member 40 is preferably used for detecting the lifetime of the image carrying member 40 and the lifetime of each of rollers included in the process cartridge 1 which are rotated along with rotation of the image carrying member 40. FIG. 14 is a schematic view of detection mechanism of detecting the number of rotations of the image carrying member 40. An image carrying member rotation detection mark 40*a* is provided at one end of the image carrying member 40. A reflection sensor 40*b* is arranged at a position facing the image carrying member rotation detection mark 40*a*. The reflection sensor 40*b* is connected to the I/O port (illustrated in FIG. 2) of the engine control board 510. The image carrying member rotation detection signal 519 is sent from the reflection sensor 40*b* and sent to the CPU via the I/O port. This image carrying member rotation detection signal 519 of the image carrying member rotation detection mark 40*a* is detected by the reflection sensor 40*b* and sent to the CPU, and the CPU counts the image carrying member rotation detection signal 519. Accordingly, the number of rotations of the image carrying member 40 is detected. In the present example, the image carrying member rotation detection signal 519 is sent to the CPU of the image forming apparatus 100. Alternatively, an I/O port may be connected to the CPU 10*a* of the IC chip 10 so that the image carrying member rotation detection signal 519 is sent to the CPU 10*a* of the IC chip 10.

Figure 15:
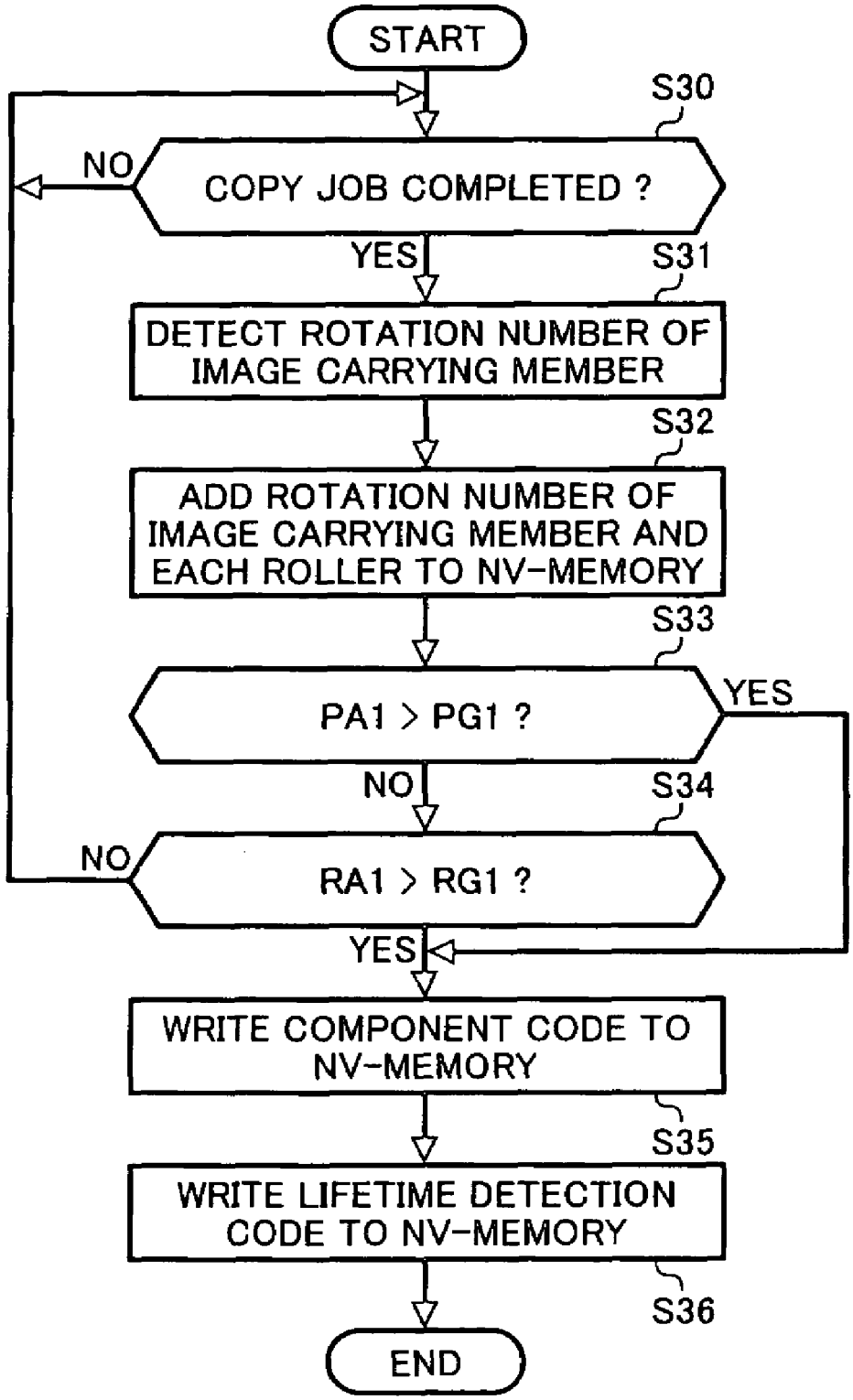
FIG. 15 is a flowchart of an image carrying member rotation number check operation.

FIG. 15 is a flowchart illustrating an operation of detecting the lifetime of the process cartridge 1 based on the number of rotations of the image carrying member 40. It is first determined if the copying operation has ended (Step S30). If it is determined that the copying operation has not ended (NO in Step S30), Step S30 and its subsequent steps are repeated. If it is determined that the copying operation has ended (YES in Step S30), the number of rotations of the image carrying member 40 is detected (Step S31). Thereafter, communication with the NV-memory 11 is established. Then, a cumulative number of rotations of the image carrying member 40 stored in the NV-memory 11 is read, and the number of rotations of the image carrying member 40 is added by the CPU. The added cumulative number of rotations of the image carrying member 40 is written to the NV-memory 11. Based on the number of rotations of the image carrying member 40, the number of rotations of each of the rollers included in the process cartridge 1, such as the development roller 5*a* and the charging roller 4*a*, which are rotated along with the rotation of the image carrying member 40, is calculated. Then, the cumulative number of rotations of the each of the rollers stored in the NV-memory 11 is read, and the number of rotations of the each of the rollers is added. The added cumulative number of rotations of the each of the rollers is written to the NV-memory 11 (Step S32). After the number of rotations of the image carrying member 40 and the number of rotations of each of the rollers are written to the NV-memory 11, the limit number of rotations of the image carrying member 40 (PG1) stored in the NV-memory 11 and the cumulative number of rotations of the image carrying member 40 (PA1) are read, and the CPU of the image forming apparatus 100 compares the limit number of rotations of the image carrying member 40 with the cumulative number of rotations of the image carrying member 40 (Step S33).

If it is determined, based on the comparison that the cumulative number of rotations of the image carrying member 40 has exceeded the limit number of rotations of the image carrying member 40, i.e., PA1>PG1 (YES in Step S33), it is determined that the image carrying member 40 is at the end of its lifetime, and the component code of the image carrying member 40 is written to the NV-memory 11 (Step S35). Then, the lifetime detection code of the number of rotations of the image carrying member 40 is written to the NV-memory 11 (Step S36), and the lifetime detection operation based on the number of rotations of the image carrying member 40 ends.

If it is determined, based on the comparison that the cumulative number of rotations of the image carrying member 40 has not exceeded the limit number of rotations of the image carrying member 40, i.e., PA2≦PG1 (NO in Step S33), the cumulative number of rotations of each of the rollers (RA1) and the limit number of rotations of the each of the rollers (RG1) are read from the NV-memory 11, and the CPU compares the cumulative number of rotations of the each of the rollers with the limit number of rotations of the each of the rollers (Step S34).

If it is determined, based on the comparison that the cumulative number of rotations of any of the rollers has exceeded the limit number of rotations of the any of the rollers, i.e., RA1>RG1 (YES in Step S34), the component code of the any of the rollers detected to be at the end of its lifetime is written to the NV-memory 11 (Step S35). Then, the lifetime detection code is written to the NV-memory 11 (Step S36), and the lifetime detection operation ends.

If it is determined, based on the comparison that the cumulative number of rotations of any of the rollers has not exceeded the limit number of rotations of the any of the rollers, i.e., RA1≦RG1 (NO in Step S34), the Step S30 and its subsequent steps are repeated.

The lifetime detection operation of the rollers is performed based on the number of rotations of the image carrying member 40. Alternatively, each of the rollers may be provided with a rotation detection mechanism so that the lifetime of each of the rollers is determined based on the number of rotations detected by the rotation detection mechanism. Further, although the lifetime detection operation of the image carrying member 40 is first detected in the present example, the lifetime detection operation of each of the rollers may be first detected.

In the process cartridge 1 including the toner container 6, the toner-end may be determined as the end of the lifetime of the process cartridge 1. The image forming apparatus 1 includes the known toner-end detection sensor 518. The toner-end detection sensor 518 detects the toner-end of the toner container 6 included in the process cartridge 1. The toner-end detection sensor 518 is connected to the I/O port (illustrated in FIG. 2) of the engine control board 510, and a toner-end signal output from the toner-end detection sensor 518 is sent to the CPU via the I/O port. The toner-end signal detected by the toner-end detection sensor 518 is sent to and read by the CPU. Alternatively, the toner-end signal may be sent to the CPU 10*a* of the IC chip 10.

Figure 16:
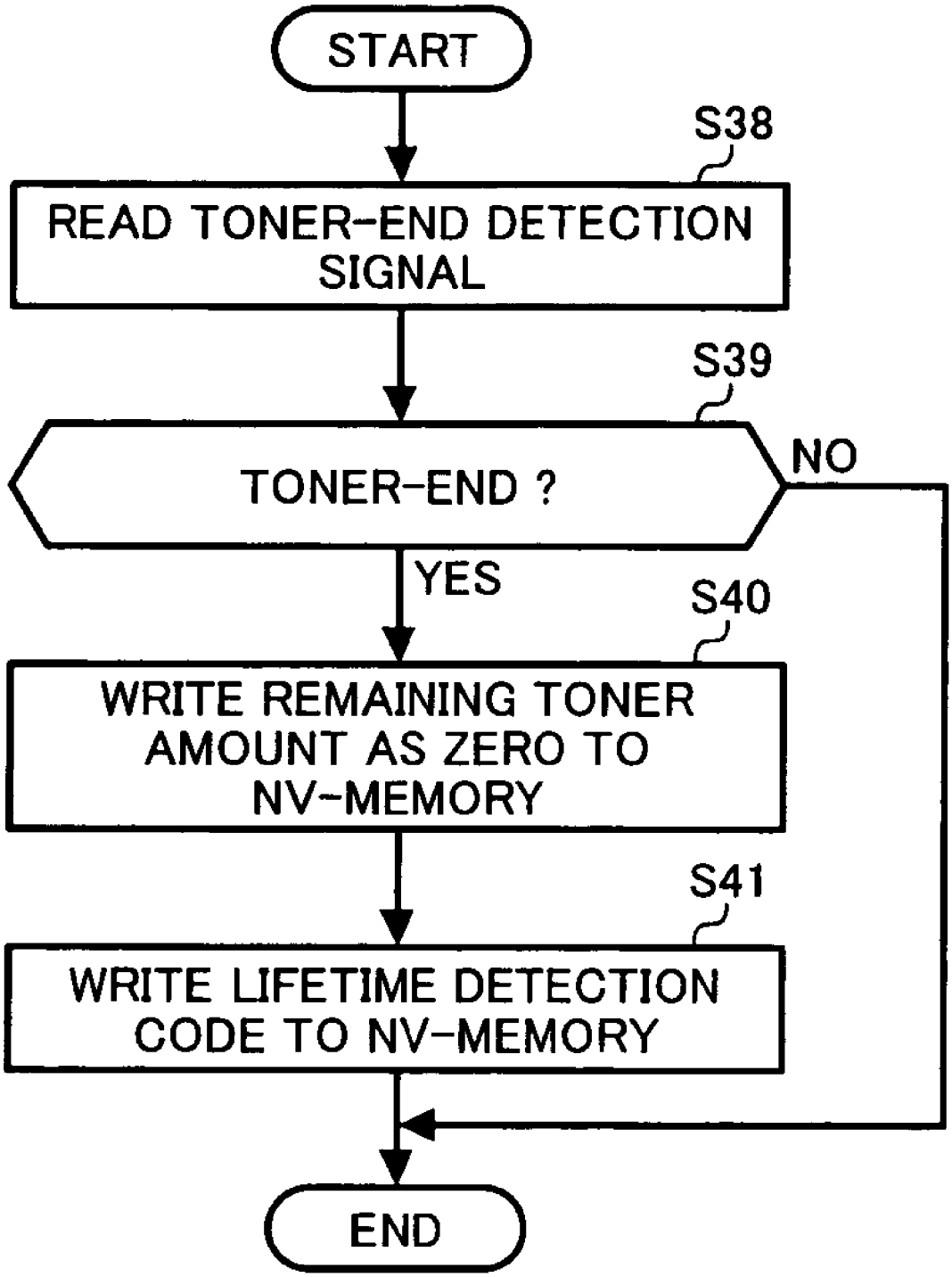
FIG. 16 is a flowchart of a toner-end check operation.

With reference to a flowchart of FIG. 16, an operation of detecting the lifetime of the process cartridge 1 based on detection of the toner-end is described. A signal detected by the toner-end detection sensor 518 is first read by the CPU (Step S38). It is then determined whether or not the signal indicates the toner-end (Step S39). If it is determined that the signal indicates the toner-end (YES in Step S39), communication is established with the NV-memory 11, and a remaining amount of toner is recorded as zero in the NV-memory 11 (Step S40). Then, the lifetime detection code corresponding to the toner-end detection is written to the NV-memory 11 (Step S41), and the lifetime detection operation based on the toner-end detection ends. If it is determined that the signal does not indicate the toner-end (NO in Step S39), the lifetime detection operation based on the toner-end detection ends.

The image forming apparatus 100 according to the present embodiment communicates with the NV-memory 11 of the process cartridge 1 at such occasions as at the power-on of the image forming apparatus 100, at the end of the copying operation, and upon opening of a door of the image forming apparatus 100, to determine if the process cartridge 1 attached to the image forming apparatus 100 is usable.

Figure 17:
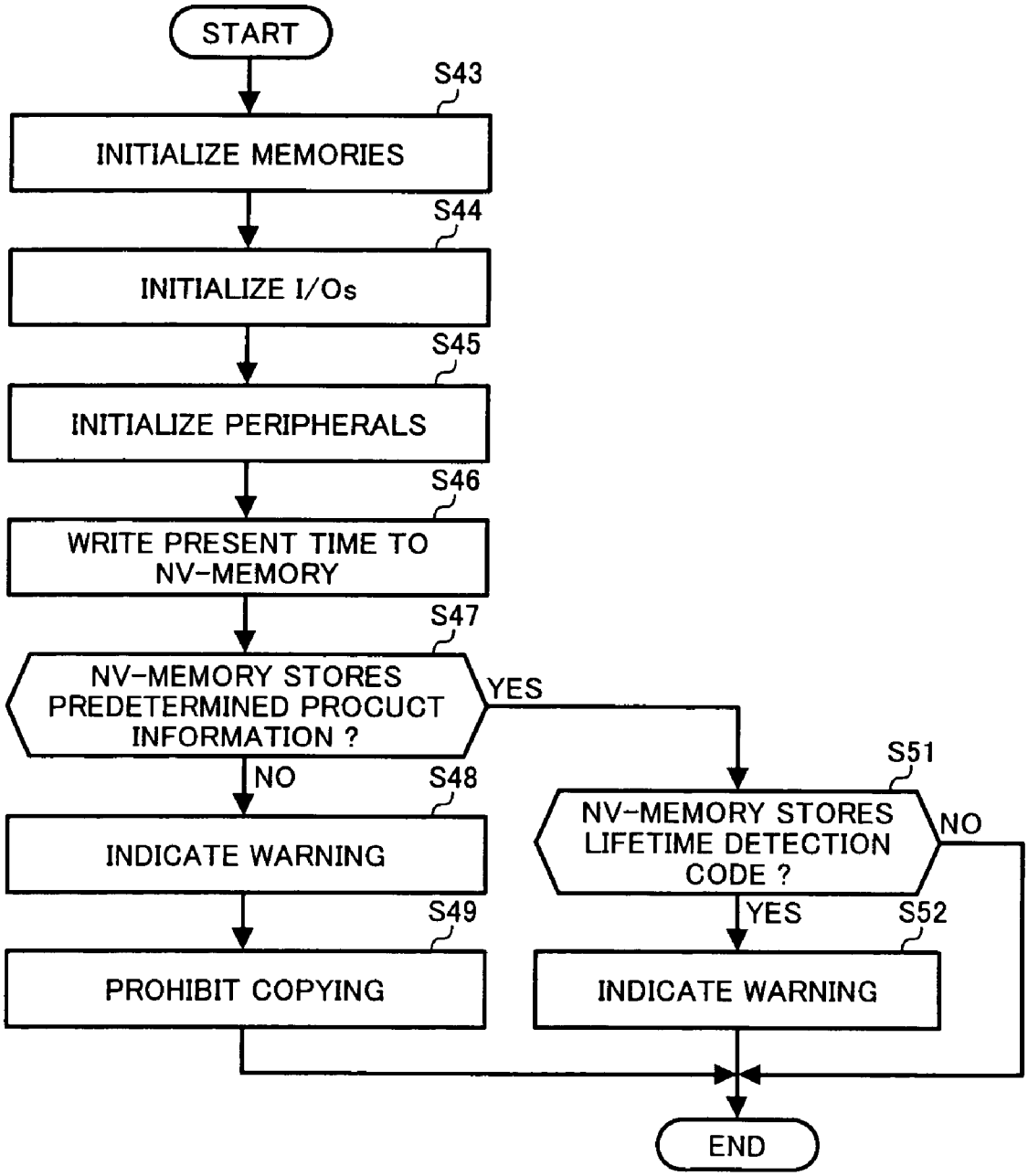
FIG. 17 is a flowchart of an initialization operation.

With reference to FIG. 17, a detection control of detecting usability of the process cartridge 1 performed at the power-on of the image forming apparatus 100 is described. FIG. 17 is a flowchart illustrating the detection control operation of detecting usability of the process cartridge 1 performed at the power-on of the image forming apparatus 100. When the image forming apparatus 100 is turned on, initialization processing of memories is performed (Step S43). Further, initialization processing of the I/Os of the image forming apparatus 100 is performed (Step S44), and then initialization processing of peripheral devices is performed (Step S45). Then, the present time is recorded on the NV-memory 11 of the process cartridge 1 (Step S46). Product information such as the product code, the reproduction code, the manufacturer code, and the identification number is checked (Step S47).

If it is determined, based on the check that the product information does not include a predetermined code (NO in Step S47), it is determined that a process cartridge improperly reproduced or manufactured has been attached to the image forming apparatus 100 during a power-off time of the image forming apparatus 100, and a warning message indicating that the proper process cartridge 1 is not attached to the image forming apparatus 100 is displayed (Step S48). Then, a copy button of the operation unit is displayed with a red color and the copying operation is prohibited (Step S49), and the detection control operation ends.

When it is determined that the product information stored in the NV-memory 11 includes the predetermined code (YES in Step S47), it is checked if the lifetime detection code is stored in the NV-memory 11 (in Step S51). If it is determined that the lifetime detection code is stored in the NV-memory 11 (YES in Step S51), a warning message indicating that the process cartridge 1 or a device or component included in the process cartridge 1 is at the end of its lifetime is displayed (Step S52), and the detection control operation ends. Alternatively, the device or component detected to be at the end of its lifetime may be displayed upon displaying the warning message. Further, a list of components or devices which need to be replaced may be displayed. In this way, a user is notified of the component or device which needs to be replaced when the warning message is displayed, and thus the user can replace the process cartridge 1. If it is determined that the lifetime detection code is not stored in the NV-memory 11 (NO in Step S51), the detection control operation ends.

In the present example, the detection control operation of detecting usability of the process cartridge 1 is performed in the initialization processing. Alternatively, the detection control operation may be performed independently of the initialization processing.

Figure 18:
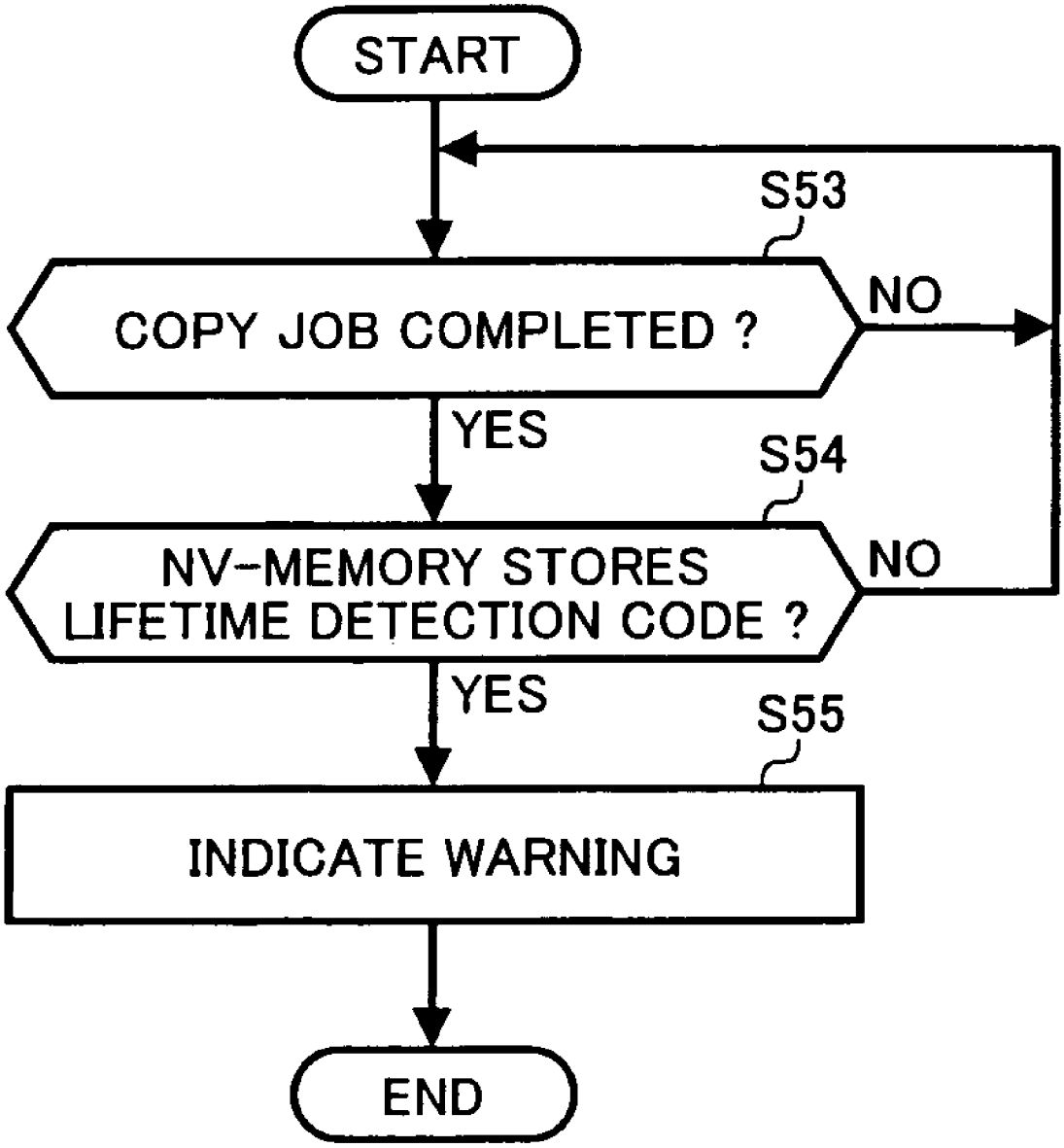
FIG. 18 is a flowchart of a lifetime detection check operation.

With reference to FIG. 18, a detection control of detecting usability of the process cartridge 1 performed at the end of the copying operation is described. FIG. 18 is a flowchart illustrating the detection control operation of detecting usability of the process cartridge 1 performed at the end of the copying operation. It is first checked if the copying operation has ended (Step S53). If it is determined that the copying operation has not ended (NO in Step S53), the Step 53 and its subsequent steps are repeated. If it is determined that the copying operation has ended (YES in Step S53), it is checked if the lifetime detection code is stored in the NV-memory 11 (Step S54). If it is detected that the lifetime detection code is stored in the NV-memory 11 (YES in Step S54), a warning message indicating that the process cartridge 1 is at the end of its lifetime is displayed (Step S55), and the detection control operation ends. If it is determined that the lifetime detection code is not stored in the NV-memory 11 (NO in Step S54), the Step S53 and its subsequent steps are repeated again. In this way, the lifetime of the process cartridge 1 is checked at the end of the copying operation. Accordingly, even if the lifetime of the process cartridge 1 ends during operation of the image forming apparatus 100, the user is promptly notified of the end of the lifetime of the process cartridge 1.

Figure 19:
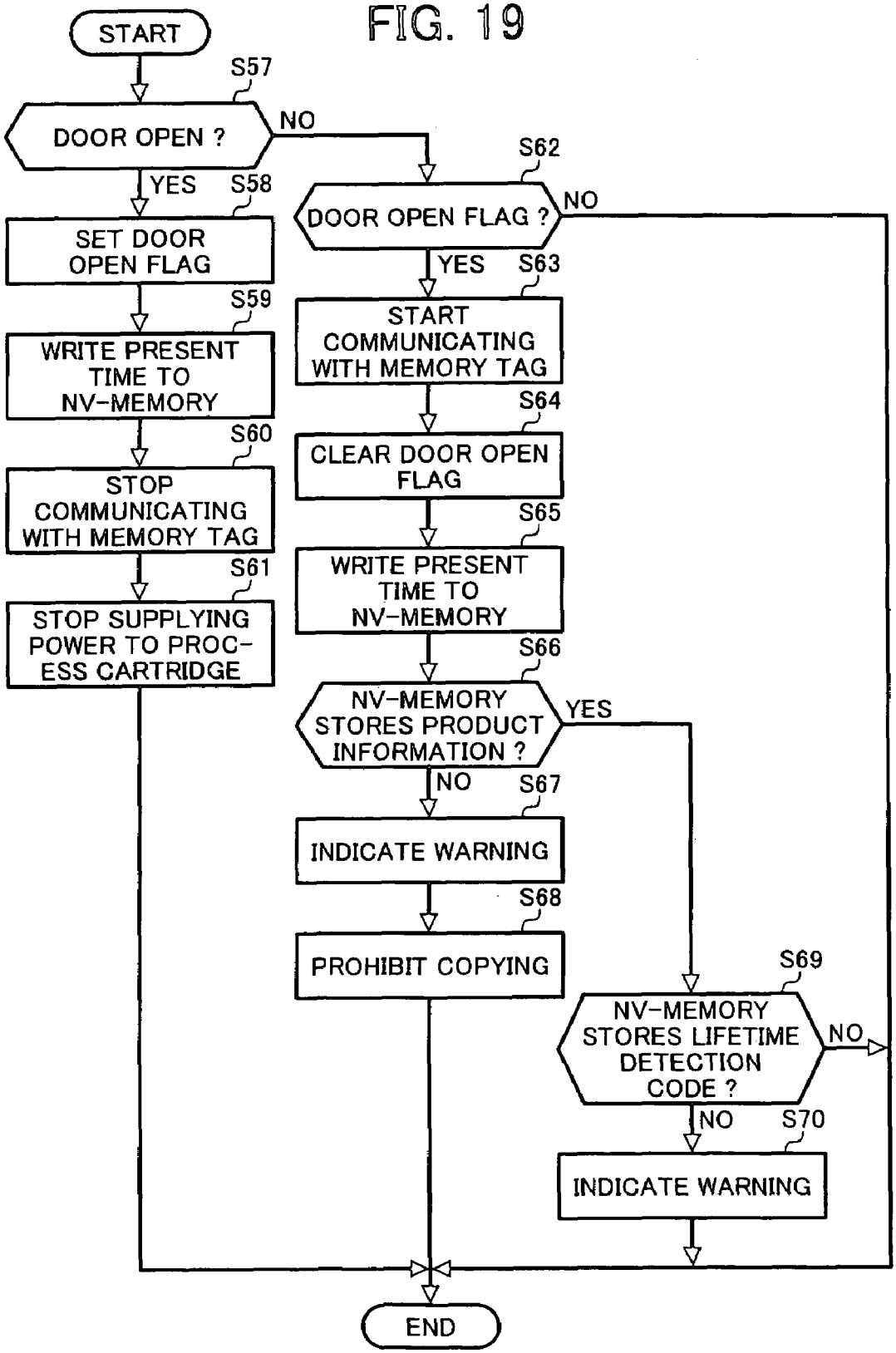
FIG. 19 is a flowchart of a process cartridge check operation.

With reference to FIG. 19, a detection control of detecting usability of the process cartridge 1 performed upon opening of the door of the image forming apparatus 100 is described. FIG. 19 is a flowchart illustrating the detection control operation of detecting usability of the process cartridge 1 performed upon opening of the door of the image forming apparatus 100. The CPU of the image forming apparatus 100 first checks if the door of the image forming apparatus 100 is open (Step S57). If it is determined that the door is open (YES in Step S57), a door open flag is set (Step S58), and the present time is written to the NV-memory 11 (Step S59). Then, communication with the NV-memory 11 is stopped (Step S60), and power supply to the process cartridge 1 is stopped (Step S61). Then, the detection control operation ends.

If it is determined that the door of the image forming apparatus 100 is not open (NO in Step S57), the CPU of the image forming apparatus 100 checks if the door open flag is set (in Step S62). If it is determined that the door open flag is not set (NO in Step S62), it is determined that the door is not open, and the detection control operation ends. If it is determined that the door open flag is set (YES in Step S62), it is determined that the door is open, and communication with the NV-memory 11 is resumed (Step S63). Then, the door open flag is cleared (Step S64), and the present time is written to the NV-memory 11 (Step S65). Further, the product information such as the product code, the reproduction code, the manufacturer code, and identification code stored in the NV-memory 11 is checked (Step S66). If it is determined based on the check that the product information does not include a predetermined code (NO in Step S66), it is determined that a process cartridge improperly reproduced or manufactured is attached to the image forming apparatus 100, and a warning message indicating that the proper process cartridge 1 is not attached to the image forming apparatus 100 is displayed (Step S67). Then, the copy button of the operation unit is displayed with the red color, and the copying operation is prohibited (Step S68). Then, the detection control operation ends.

If it is determined that the product information stored in the NV-memory 11 includes the predetermined code (YES in Step S66), it is checked if the lifetime detection code is stored in the NV-memory 11 (in Step S69). If it is determined that the lifetime detection code is stored in the NV-memory 11 (YES in Step S69), a warning message indicating that the process cartridge 1 or a device included in the process cartridge 1 is at the end of its lifetime is displayed (Step S70), and the detection control operation ends. If it is determined that the lifetime detection code is not stored in the NV-memory 11 (NO in Step S69), the detection control operation ends.

In this way, the lifetime of the process cartridge 1 is checked upon opening of the door of the image forming apparatus 100. Therefore, even if the user erroneously attaches the process cartridge 1, which has been detected to be at the end of its lifetime, to the image forming apparatus in replacement of the process cartridge 1, the error can be detected. Further, attachment of an improper process cartridge can be detected.

A reproduction operation of the process cartridge 1 detected to be at the end of its lifetime is described. The process cartridge 1 detected to be at the end of its lifetime is detached from the image forming apparatus 100 by a user or a serviceman and sent to a recycling factory. The NV-memory 11 of the thus detached process cartridge 1 stores lifetime information of the device or component detected to be at the end of its lifetime. The process cartridge 1 is reproduced based on the lifetime information.

Figure 20:
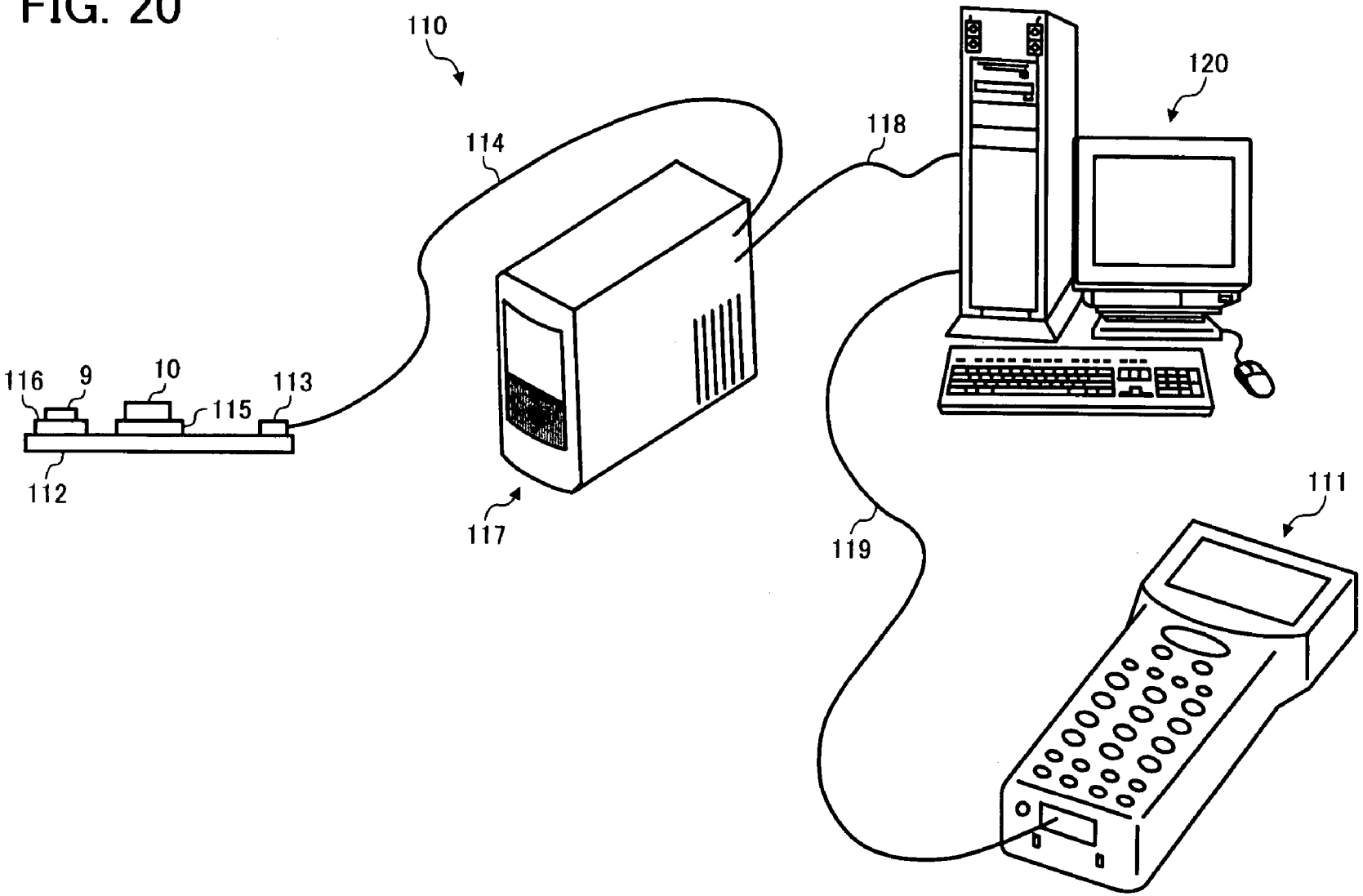
FIG. 20 is a diagram illustrating a reading device.

FIG. 20 is a schematic diagram illustrating a configuration of a reading device 110 which reads the lifetime information from the NV-memory 11 and writes reproduction information to the NV-memory 11 in the reproduction operation of the process cartridge 1. The reading device 110 includes a reader/writer 111 which exchanges information with the contactless memory tag 9 or IC chip 10, and a reading/writing board 112 which exchanges information with the contact-type memory tag 9 or IC chip 10. The reading/writing board 112 includes an IC chip socket 115 on which the IC chip 10 is mounted, and a memory tag socket 116 on which the memory tag 9 is mounted. The reading/writing board 112 further includes a connector 113 which is connected to a reading/writing device 117 via a 12C bus 114. The reading/writing device 117 is connected to a computer 120 via a connection such as a USB (universal serial bus) 118. The reader/writer 111 is typically connected to the computer 120 via a USB 119.

If the memory tag 9 or IC chip 10 is the contact-type, the memory tag 9 or IC chip 10 is detached from the process cartridge 1 and mounted on the IC chip socket 115 or the memory tag socket 116 of the reading/writing board 112. Thereafter, communication with the reading/writing device 117 is established, and the information used for reproducing the process cartridge 1 (e.g., the component code or device code of the component or device detected to be at the end of its lifetime, the lifetime detection code, the use history information of each component or device) is read from the NV-memory 11. The information read from the NV-memory 11 is sent to the computer 120 via the reading/writing device 117. The process cartridge 1 is reproduced based on this information sent to the computer 120. After the process cartridge 1 is reproduced, the reproduction information is written to the memory tag 9 or IC chip 10 from the computer 120 via the reading/writing device 117. The reproduction information (e.g., the component code or device code of the replaced component or device, guarantee information of the component or device, the reproduction code, the number of recycling (i.e., reproduction) operations, the toner supply amount, the toner supply date, and a color identification) is recorded on the memory tag 9 or IC chip 10, and the memory tag 9 or IC chip 10 is detached from the IC chip socket 115 or the memory tag socket 116 of the reading/writing board 112 and attached again to the reproduced process cartridge 1.

If the memory tag 9 or IC chip 10 is the contactless-type, communication with the memory tag 9 or IC chip 10 attached to the process cartridge 1 is established by the reader/writer 111, and the information used for reproducing the process cartridge 1 is read from the NV-memory 11. The read information is sent to the computer 120 via the reader/writer 111. The process cartridge 1 is reproduced based on the information used for reproducing the process cartridge 1 which is sent to the computer 120. Then, the reproduction information is sent from the computer 120 and written to the NV-memory 11 via the reader/writer 111.

A flow of the reproduction operation of the process cartridge 1 is described. The reproduction operation of the process cartridge 1 mainly includes four stages. In the first stage, the device or component which needs to be replaced is found based on the reproduction information stored in the NV-memory 11. In the second stage, a new device or component which replaces the current device or component is determined and replacement of the device or component is performed. In the third stage, the lifetime guarantee period is newly set based on the use history information stored in the NV-memory 11 and the replaced component or device. In the fourth stage, information stored in the NV-memory 11 is erased and the reproduction information is written to the NV-memory 11.

The First Stage.

Figure 21:
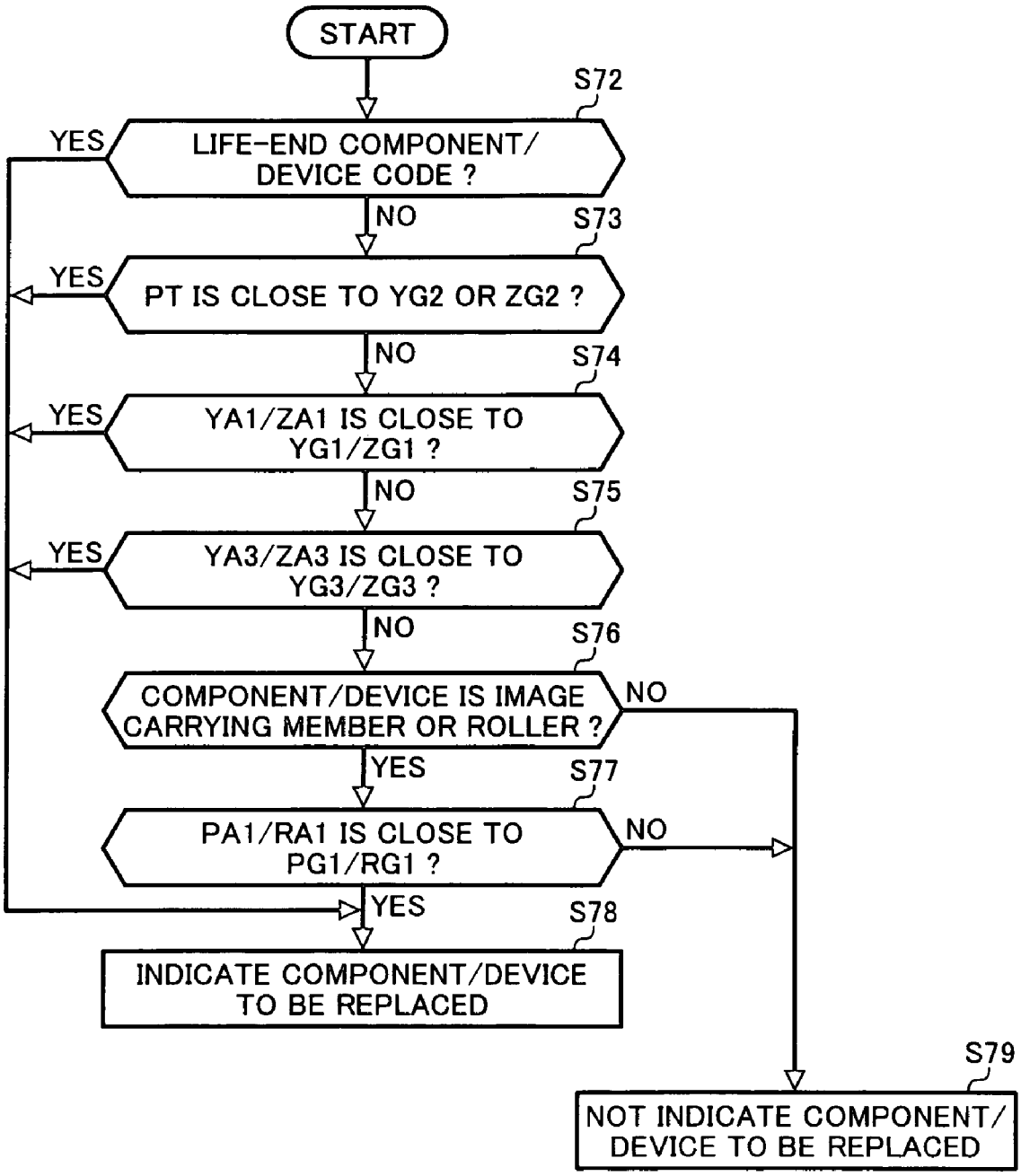
FIG. 21 is a flowchart of a replacement component check operation.

FIG. 21 is a flowchart illustrating the first stage. A life-end component code or a life-end device code is read from the NV-memory 11 to check if each of the components and devices of the process cartridge 1 has its life-end component code or life-end device code (Step S72). If it is determined that any of the components and devices of the process cartridge 1 has the life-end component code or life-end device code (YES in Step S72), a message indicating that the any of the components and devices needs to be replaced is displayed on the computer 120 (Step S78).

For each of the components and devices included in the process cartridge 1 which does not have the corresponding life-end component code or life-end device code (NO in Step S72), it is checked if the present date (PT) is close to the use guarantee limit date of each of the components and devices included in the process cartridge 1 (YG2, ZG2) stored in the NV-memory 11 (Step S73). If it is determined that the present date is close to the use guarantee limit date of any of the components and devices (YES in Step S73), a message indicating that the any of the components and devices needs to be replaced is displayed on the computer 120 (Step S78).

For each of components and devices included in the process cartridge 1 which has the use guarantee limit date determined not to be close to the present date (NO in Step S73), it is checked if the cumulative operation time of each of the components and devices (YA1, ZA1) is close to the operation guarantee time thereof (YG1, ZG1) (Step S74). If it is determined that the cumulative operation time of any of the components and devices is close to the operation guarantee time thereof (YES in Step S74), a message indicating that the any of the components and devices needs to be replaced is displayed on the computer 120 (Step S78). For each of components and devices which has the cumulative operation time determined not to be close to the operation guarantee time thereof (NO in Step S74), it is checked if the cumulative number of copies of each of the components and devices (YA3, ZA3) is close to the limit number of copies thereof (YG3, ZG3) (Step S75). If it is determined that the cumulative number of copies of any of the components and devices is close to the limit number of copies thereof (YES in Step S75), a message indicating that the any of the components and devices needs to be replaced is displayed on the computer 120 (Step S78). For each of components and devices which has the cumulative number of copies determined not to be close to the limit number of copies thereof (NO in Step S75), it is checked if each of the components and devices is the image carrying member 40 or rollers (Step S76). If it is determined that any of the components and devices is not the image carrying member 40 or rollers (NO in Step S76), the components or device is determined to be unnecessary to be replaced and is not displayed on the computer 120 (Step S79). If any of the components and devices is determined to be the image carrying member 40 or rollers (YES in Step S76), it is checked if the cumulative number of rotations of the image carrying member 40 or rollers is close to the limit number of rotations thereof (Step S77). If it is determined that the cumulative number of rotations of the any of the rollers or image carrying member 40 is close to the limit number of rotations thereof (YES in Step S77), a message indicating that the image carrying member 40 or roller at issue needs to be replaced is displayed on the computer 120 (Step S78).

If it is determined that the cumulative number of rotations of the any of the rollers or image carrying member 40 is not close to the limit number of rotations thereof (NO in Step S77), the rollers and image carrying member 40 and rollers are determined to be unnecessary to replace, no message regarding their replacement is displayed on the computer 120 (Step S79).

In the first stage of finding the device or component which needs to be replaced, the computer 120 displays the device or part which is detected to be at the end of its lifetime, and also displays the device or component which is detected to be approaching the end of its lifetime based on the use history and the guarantee information recorded in the NV-memory 11. Thus, it is prevented that the lifetime of the process cartridge 1 ends immediately after a component or device is replaced.

The Second Stage.

In the second stage, a new component or device which replaces the current component or device is determined based on a use situation of the process cartridge 1, and replacement of the component or device is performed. For example, if the new component or device is relatively expensive, durable, and long-lasting, the replacement is ineffective if the lifetime of the process cartridge 1 ends before the lifetime of the newly provided component or device ends. Further, the new component or device varies depending on a degree of deterioration of the current component or device. In the second stage, therefore, the use history information (e.g., the cumulative operation time, the cumulative number of copies, the cumulative number of rotations, and device abnormality information such as abnormality detected by the T sensor and abnormality in the charging device 4) is read from the NV-memory 11 to determine a suitable new component or device which replaces the current component or device. Accordingly, the suitable new component or device can be selected based on the degree of deterioration of the current component or device and the lifetime of the component or device. The current component or device is then replaced by the new component or device determined as described above.

The Third Stage.

In the third stage, the lifetime guarantee period of the process cartridge 1 is newly set based on the use history information stored in the NV-memory 11 or depending on the replaced component or device. Some of the newly provided components or devices extend the lifetime of the process cartridge 1. In this case, if the lifetime guarantee period of the process cartridge 1 is unchanged, it is determined that the lifetime of the process cartridge 1 has ended and thus the process cartridge 1 needs to be replaced, even when the process cartridge 1 is still usable. This is uneconomical. In the third stage, therefore, the lifetime guarantee period of the process cartridge 1 is newly set based on such factors as the degree of deterioration of the component or device replaced, quality of the component or device replaced, and the use state of the component or device. The cumulative operation time of the process cartridge 1 and the cumulative operation time of the components and devices which are not replaced are read from the NV-memory 11 and sent to the computer 120. The computer 120 stores also the property information and the operation guarantee time of the replaced component or device. The operation guarantee time of the new process cartridge 1 can be obtained based on such information. Similarly, the use guarantee period of the process cartridge 1 and the limit number of copies of the process cartridge 1 are obtained.

The Fourth Stage.

The fourth stage includes a step of erasing the lifetime information of the component or device replaced in the second stage, which is stored in the NV-memory 11, and a step of writing the lifetime guarantee period of the new process cartridge 1, which is calculated in the third stage and the reproduction information such as the lifetime guarantee period of the replaced component or device. In the present example, the computer 120 of the reading device 110 illustrated in FIG. 20 outputs a write signal and an erase signal to erase data stored in the NV-memory 11 and write data in the NV-memory 11.

Figure 22A:
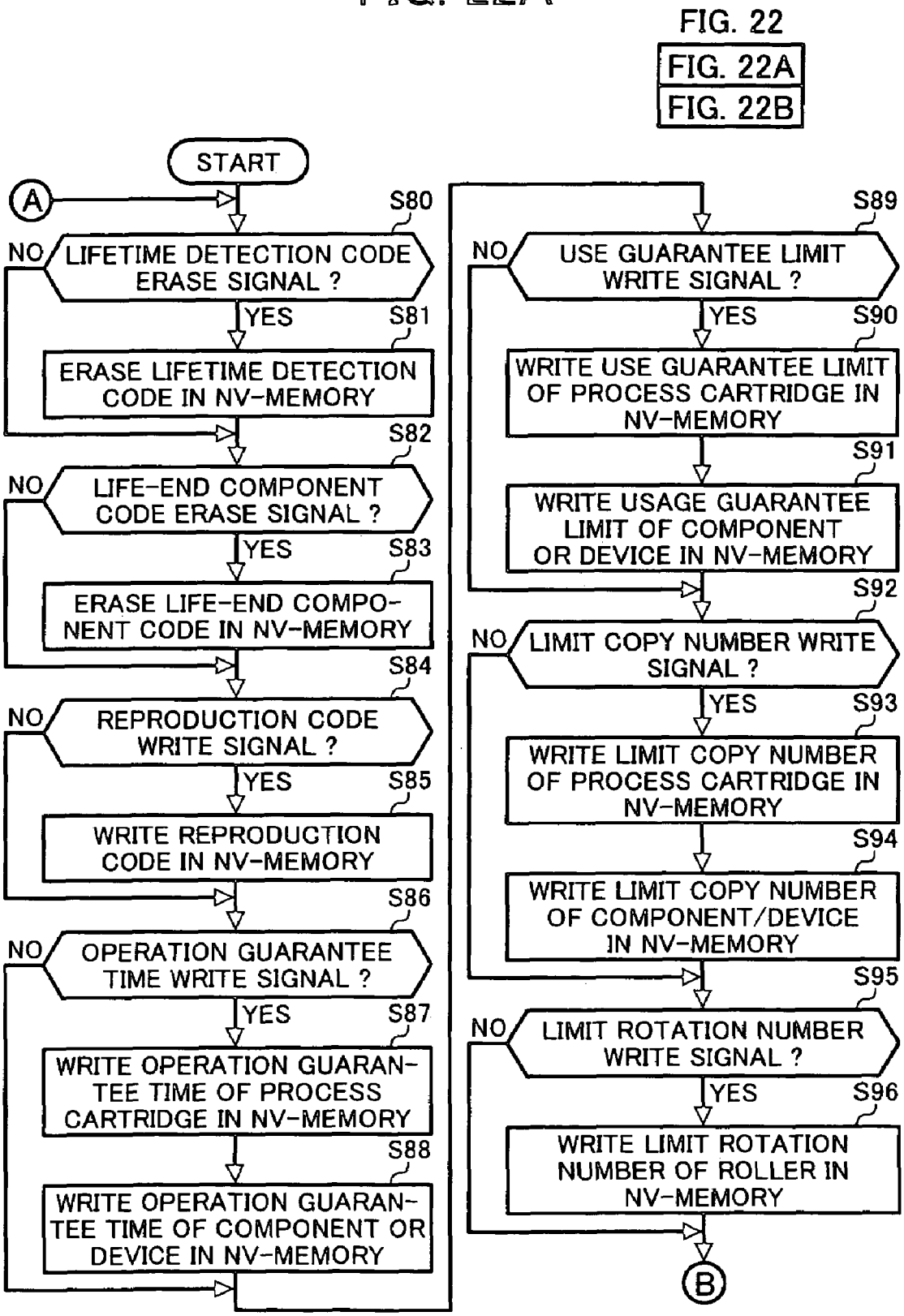
FIG. 22 is a flowchart of a reproduction information writing operation.
Figure 22B:
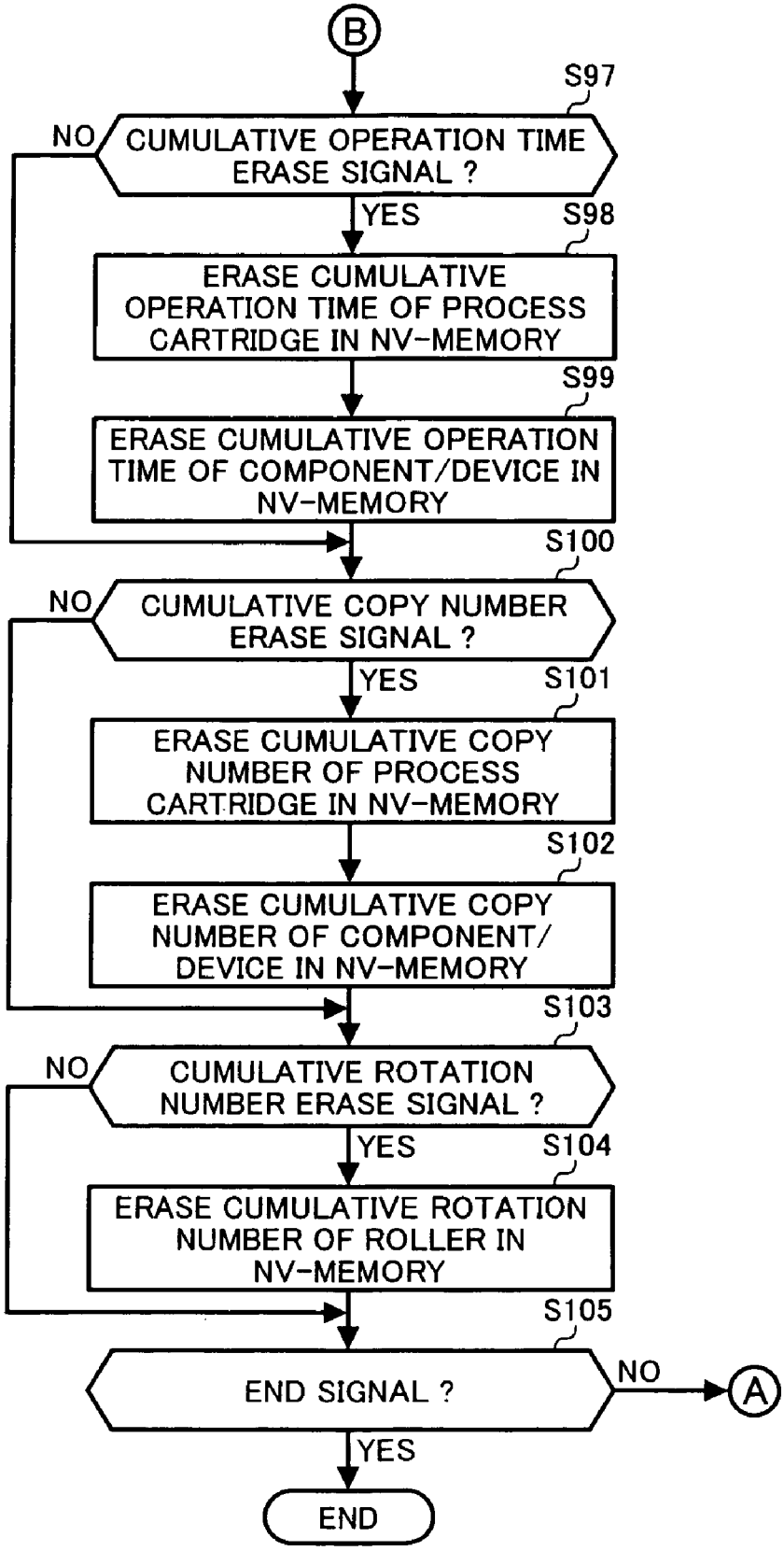

FIG. 22 is a flowchart illustrating the fourth stage. It is first checked if the computer 120 sends a lifetime detection code erase signal (Step S80). If it is determined that the computer 120 sends the lifetime detection code erase signal (YES in Step S80), communication with the NV-memory 11 is established, and the lifetime detection code stored in the NV-memory 11 is erased (Step S81). It is then checked if the life-end component code erase signal is sent from the computer 120 (Step S82). If it is determined that the computer 120 sends the life-end component code erase signal (YES in Step S82), communication with the NV-memory 11 is established, and the life-end component code stored in the NV-memory 11 is erased (Step S83). If the computer 120 sends a reproduction code write signal (YES in Step S84), the reproduction code is written to the NV-memory 11 (Step S85). If the process cartridge 1 is previously reproduced, the previous reproduction code is overwritten.

The reproduction code is a part of the product information, and indicates that the process cartridge 1 has been properly reproduced. When the computer 120 sends an operation guarantee time write signal (YES in Step S86), the operation guarantee time of the new process cartridge 1 calculated in the third stage and the operation guarantee time of the replaced component or device are overwritten to the respective previous operation guarantee times stored in the NV-memory 11 (Steps S87 and S88).

If it is determined that the sent signal is a use guarantee limit write signal (YES in Step S89), the use guarantee limit of the new process cartridge 1 calculated in the third stage and the use guarantee limit of the replaced component or device are overwritten to the respective previous use guarantee limits stored in the NV-memory 11 (Steps S90 and S91).

If it is determined that the sent signal is a limit copy number write signal (YES in Step S92), the newly calculated limit number of copies of the new process cartridge 1 and the newly calculated limit number of copies of the replaced component or device are overwritten to the respective previous limit numbers of copies (Steps S93 and S94).

If the replaced component or device is the image carrying member 40 or a roller, a limit rotation signal is sent.

If it is determined that the sent signal is a limit rotation number write signal (YES in Step 95), the limit number of rotations of the replaced image carrying member 40 or roller is overwritten (Step 96).

If it is determined that the signal is a cumulative operation time erase signal (YES in Step S97), the cumulative operation time of the process cartridge 1 stored in the NV-memory 11 and the cumulative operation time of the replaced component or device are erased (Steps S98 and S99).

If it is determined that the signal is a cumulative copy number erase signal (YES in Step S100), the cumulative number of copies of the process cartridge 1 and the cumulative number of copies of the replaced component or device are erased (Steps S101 and S102).

If it is determined that the replaced component or device is the image carrying member 40 or a roller, a cumulative rotation number erase signal is sent, and the cumulative number of rotations of the replaced image carrying member 40 or roller is erased (Step S104). After the data writing operation and the data erasing operation in the NV-memory 11 ends, an end signal is sent (YES in Step S105), and the operation of the fourth stage ends.

The operation illustrated in FIG. 22 is one example, and thus the operation of the fourth stage is not limited to this. For example, if toner is supplied to the toner container 6, an overwriting operation of overwriting the use guarantee limit of the toner to the NV-memory 11 is added to the operation described above.

In the process cartridge 1 according to the present example, a device can be attached to and detached from the process cartridge 1 with relative ease. Therefore, the user or serviceman can reproduce the process cartridge 1 which is detected to be at the end of its lifetime, instead of sending the process cartridge 1 to the recycle factory and reproducing the process cartridge 1 there. A reproduction operation of the process cartridge 1 performed by the user or serviceman is described below.

The image forming apparatus 100 has a user-mode key for allowing the user or servicemen to reproduce the process cartridge 1. When a warning message indicating the end of the lifetime of the process cartridge 1 is displayed on the image forming apparatus 100, the user operates the user-mode key to switch to a user mode. Then, the user can replace the component or device detected to be at the end of its lifetime with a new component or device by referring to the warning message displayed on the image forming apparatus 100.

Figure 23:
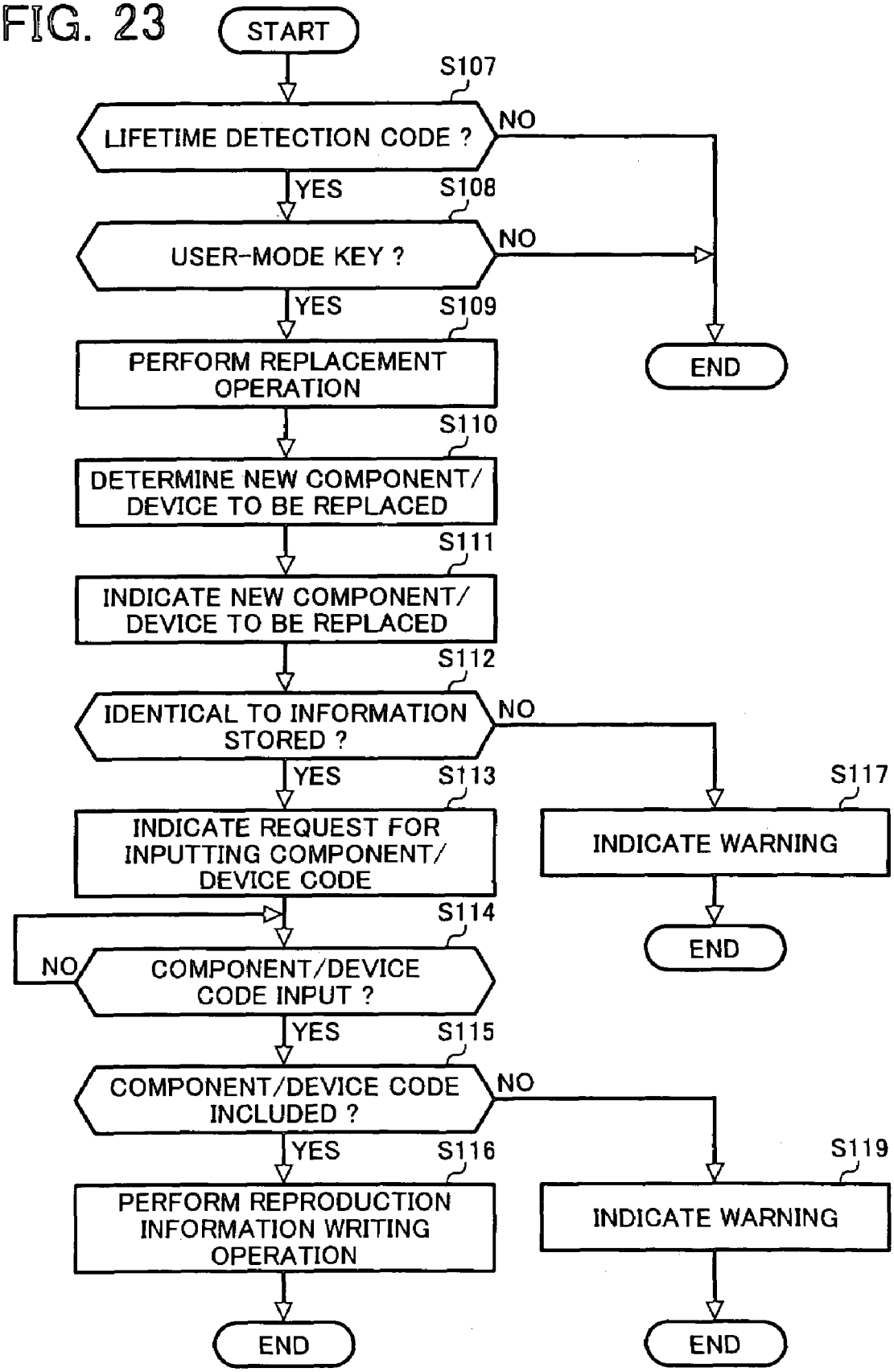
FIG. 23 is a flowchart of a reproduction operation performed by a user.

FIG. 23 is a flowchart illustrating the reproduction operation of the process cartridge 1 performed by the user or serviceman. It is first checked if the NV-memory 11 stores the lifetime detection code (Step S107). If it is determined that the NV-memory 111 does not store the lifetime detection code (NO in Step S107), it is determined that any of the components and devices included in the process cartridge 1 is not at the end of its lifetime, and thus the reproduction operation ends. If it is determined that the NV-memory 11 stores the lifetime detection code (YES in Step S1107), it is checked if the user-mode key is selected (Step S108). If it is determined that the user-mode key is not selected (NO in Step S108), the reproduction operation ends. If it is determined that the user-mode key is selected (YES in Step S108), the replacement operation illustrated in FIG. 21 is performed (Step S109). In this replacement operation, a component detected to be approaching to the end of its lifetime can be also replaced. Further, in this replacement operation, a component or device necessary to be replaced is found and a new component or device to be replaced is determined (Step S110). Specifically, a storage device in the image forming apparatus 100 stores information of the components and the devices in advance, and the use history information (e.g., the cumulative operation time, the cumulative number of copies, the cumulative number of rotations, the device abnormality information such as abnormality detected by the T sensor and abnormality in the charging device 4) is read from the NV-memory 11 to determine a suitable new component or device. The new component or device is not limited to one but may be plural. After the new component or device is determined, the component or device is displayed on the display unit of the image forming apparatus 100 (Step S11). The user or serviceman prepares a new component or device based on the displayed information. Then, the user opens the door of the image forming apparatus 100, pulls out the process cartridge 1 detected to be at the end of its lifetime, and replaces the component or device.

After the component or device is replaced by a new one and the process cartridge 1 is attached again to the image forming apparatus 100, communication with the NV-memory 11 is started to check if the information stored in the NV-memory 11 of the process cartridge 1 before the reproduction operation is identical with the information stored in the NV-memory 11 of the process cartridge 1 after the reproduction operation (Step S112). Specifically, it is checked if the product information such as the lifetime detection code, the life-end component code, and the reproduction code is the same before and after the reproduction operation. If it is determined that the information stored in the NV-memory 11 of the process cartridge 1 before the reproduction operation is not identical to the information stored in the NV-memory 1I of the process cartridge 1 after the reproduction operation (NO in Step S112), it is determined that the component or device was not replaced according to a command sent from the image forming apparatus 100. Therefore, a warning message indicating that the component or device is not replaced according to a command sent from the image forming apparatus 100 is displayed (Step S117), and the reproduction operation ends.

Meanwhile, if it is determined that the information stored in the NV-memory 11 of the process cartridge 1 before the reproduction operation is identical to the information stored in the NV-memory 1I of the process cartridge 1 after the reproduction operation (YES in step S112), it is determined that the component or device was replaced according to the command sent from the image forming apparatus 100, and a message prompting input of the component code or device code of the replaced component or device is displayed on the display unit of the image forming apparatus 100 (Step S113). Then, the user inputs the component code or device code of the replaced component or device in response to the command displayed on the display unit (YES in Step S114). Thereafter, it is checked if the component code or device code is included in the component code or device code determined in the Step S 110 (Step S115). If it is determined that the component code or device code is not included in the component code or device code determined in the Step S110 (NO in Step S115), a warning message indicating that the component code or device code is not included in the component code or device code determined in the Step S110 is displayed on the display unit of the image forming apparatus 100 (Step S119), and the reproduction operation ends.

In the example illustrated in FIG. 23, the reproduction operation ends immediately after displaying the warning message. Since the user may make a mistake, the reproduction operation may return to the Step S113 to display again the message prompting the input.

Further, the reproduction operation may end if different codes are input more than once. If the input component code or device code is included in the component code or device code determined in the Step S110 (YES in Step 115), it is determined that the component has been replaced in response to the command, and the reproduction information writing operation illustrated in FIG. 22 is performed (Step S116). In the reproduction information writing operation in this case, the CPU of the image forming apparatus 100 sends the erase signal or the write signal to the NV-memory 11 to erase or write the information in the NV-memory 11. After the reproduction information writing operation ends, the reproduction operation ends.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus comprising:

an image forming unit detachably provided in the image forming apparatus, the image forming unit including:

a housing;

a plurality of replaceable devices replaceably mounted inside the housing; and a control circuit configured to store lifetime information of each one of the plurality of replaceable devices into a nonvolatile memory;

store lifetime information of the image forming unit into the nonvolatile memory;

read the lifetime information of each one of the plurality of replaceable devices from the nonvolatile memory, the lifetime information of each one of the plurality of replaceable devices stored in the nonvolatile memory including a first information group including guarantee information and operation information for each one of the plurality of replaceable devices, and the lifetime information of the image forming unit stored in the nonvolatile memory including a second information group including guarantee information and operation information for the image forming unit; the control circuit being further configured to read the guarantee information included in the first information group for each one of the plurality of replaceable devices;

read the operation information included in the first information group for each one of the plurality of replaceable devices, the image forming apparatus further including a central processing unit configured to compare the guarantee information with the operation information for each one of the plurality of replaceable devices and to determine that a replaceable device is at an end of its lifetime when guarantee information corresponding to the replaceable device is approximately equal to the operation information, the control circuit being further configured to erase, from the volatile memory, the guarantee information and the operation information of the replaceable device when the replaceable device is at the end of its lifetime and to write guarantee information of a new replaceable device into the nonvolatile memory when the replaceable device determined to be at an end of its lifetime is replaced with the new replaceable device; the control circuit being further configured to read the guarantee information of the new replaceable device from the nonvolatile memory;

read the operation information of the image forming unit from the nonvolatile memory;

generate new guarantee information for the image forming unit based on guarantee information of the new replaceable device and an operation date of the image forming unit;

overwrite the guarantee information of the image forming unit with the new guarantee information; and erase the operation information of the image forming unit in the nonvolatile memory.

2. The image forming apparatus as recited in claim 1, wherein the central processing unit is mounted on the housing.

3. The image forming apparatus as recited in claim 2, wherein the image forming unit further includes:

a first detection device configured to detect an end of lifetime of the image forming unit by comparing the guarantee information with the operation information in the first information group for each one of the plurality of replaceable devices.

4. The image forming apparatus as recited in claim 3, wherein the image forming unit further includes:

a second detection device configured to detect an end of lifetime of the image forming unit by comparing the guarantee information with the operation information in the second information group for the image forming unit.

5. The image forming apparatus as recited in claim 4, wherein the lifetime information further includes information indicating a replaceable device included in the plurality of replaceable devices which is determined to be at an end of its lifetime.

6. The image forming apparatus as recited in claim 5, wherein the nonvolatile memory further stores product information of the image forming unit, image forming information including image forming conditions, and product information for each of the plurality of replaceable devices.

7. The image forming apparatus as recited in claim 4, wherein the guarantee information in the first information group for each one of the plurality of replaceable devices includes at least one of an operation guarantee time, a use limit date, a limit number of times an image forming operation is performed, a limit number of rotations, and information of toner, and wherein the guarantee information in the second information group for the image forming unit includes at least one of an operation guarantee time, a use limit date, a limit number of times the image forming operation is performed, and information of toner.

8. The image forming apparatus as recited in claim 4, wherein the operation information in the first information group for each one of the plurality of replaceable devices includes at least one of a cumulative operation time, a present date, a cumulative number of times an image forming operation is performed, a cumulative number of rotations when the device is a rotational member, and information of toner, and wherein the operation information in the second information group for the image forming unit includes at least one of a cumulative operation time, a present date, a cumulative number of times the image forming operation is performed, and information of toner.

9. The image forming apparatus as recited in claim 4, further comprising:

a notifying device configured to notify the end of the lifetime of the image forming unit in either of two events, when the first detection device detects an end of lifetime of the image forming device, and when the second detection device detects the end of lifetime of the image forming unit.

10. The image forming apparatus as recited in claim 9, further comprising:

a display device configured to display information of a current replaceable device included in the plurality of replaceable devices when the current replaceable device is determined to be at an end of its lifetime, and information of a new replaceable device to replace the current replaceable device.

11. The image forming apparatus as recited in claim 1, wherein the plurality of replaceable devices includes at least an image carrying member and a cleaning blade contacting the image carrying member to clean off a surface of the image carrying member.

12. The image forming apparatus as recited in claim 1, wherein the image forming unit forms a process cartridge which integrally stores the housing and, inside the housing, the plurality of replaceable devices includes an image carrying member and at least one of a charging device, a development device, a cleaning device, and a toner container.

13. The image forming apparatus as recited in claim 1, wherein the nonvolatile memory includes an electrically erasable and programmable read only memory.

14. The image forming apparatus as recited in claim 1, wherein the housing comprises:

two side plates arranged in parallel with each other; and a pair of holding members rotatably provided on the two side plates and configured to hold a rotational device included in the plurality of replaceable devices.

15. A process cartridge exchangeably used in an image forming apparatus, the process cartridge comprising:

a housing;

a plurality of replaceable devices replaceably mounted inside the housing; a nonvolatile memory mounted on the housing and configured to store lifetime information, based on which, ends of lifetimes are detectable with respect to the process cartridge and each of the plurality of replaceable devices; and a control circuit configured to store lifetime information of each one of the plurality of replaceable devices into a nonvolatile memory;

store lifetime information of the image forming unit into the nonvolatile memory;

read the lifetime information of each one of the plurality of replaceable devices from the nonvolatile memory, the lifetime information of each one of the plurality of replaceable devices stored in the nonvolatile memory including a first information group including guarantee information and operation information for each one of the plurality of replaceable devices, and the lifetime information of the image forming unit stored in the nonvolatile memory including a second information group including guarantee information and operation information for the image forming unit; the control circuit being further configured to read the guarantee information included in the first information group for each one of the plurality of replaceable devices;

read the operation information included in the first information group for each one of the plurality of replaceable devices, the control circuit being further configured to communicate with a central processing unit configured to compare the guarantee information with the operation information for each one of the plurality of replaceable devices and to determine that a replaceable device is at an end of its lifetime when guarantee information corresponding to the replaceable device is approximately equal to the operation information, the control circuit being further configured to erase, from the volatile memory, the guarantee information and the operation information of the replaceable device when the replaceable device is at the end of its lifetime and to write guarantee information of a new replaceable device into the nonvolatile memory when the replaceable device determined to be at an end of its lifetime is replaced with the new replaceable device; the control circuit being further configured to read the guarantee information of the new replaceable device from the nonvolatile memory, read the operation information of the image forming unit from the nonvolatile memory;

generate new guarantee information for the image forming unit based on guarantee information of the new replaceable device and an operation date of the image forming unit;

overwrite the guarantee information of the image forming unit with the new guarantee information; and erase the operation information of the image forming unit in the nonvolatile memory.

16. A method of recycling an image forming unit including a plurality of replaceable devices and used in an image forming apparatus, the method comprising:

storing lifetime information of each one of the plurality of replaceable devices into a nonvolatile memory, the lifetime information of each one of the plurality of replaceable devices stored in the nonvolatile memory including a first information group including guarantee information and operation information for each one of the plurality of replaceable devices;

storing lifetime information of the image forming unit into the nonvolatile memory, the lifetime information of the image forming unit stored in the nonvolatile memory including a second information group including guarantee information and operation information for the image forming unit;

reading the lifetime information of each one of the plurality of replaceable devices from the nonvolatile memory;

replacing a replaceable device determined to be at an end of its lifetime with a new replaceable device based on the lifetime information read in the reading;

reading the guarantee information included in the first information group for each one of the plurality of replaceable devices;

reading the operation information included in the first information group for each one of the plurality of replaceable devices;

comparing the guarantee information with the operation information for each one of the plurality of replaceable devices;

determining that a replaceable device is at an end of its lifetime when guarantee information corresponding to the replaceable device is approximately equal to the operation information, erasing, from the volatile memory, the guarantee information and the operation information of the replaceable device when the replaceable device is at the end of its lifetime;

writing guarantee information of the new replaceable device into the nonvolatile memory;

reading the guarantee information of the new replaceable device from the nonvolatile memory;

reading the operation information of the image forming unit from the nonvolatile memory;

generating new guarantee information for the image forming unit based on guarantee information of the new replaceable device and an operation date of the image forming unit;

overwriting the guarantee information of the image forming unit with the new guarantee information; and erasing the operation information of the image forming unit in the nonvolatile memory.

17. The method recited in claim 16, further comprising:

reading information of the replaceable device determined to be at the end of its lifetime from the nonvolatile memory; and displaying the information of the replaceable device determined to be at the end of its lifetime to an external apparatus.

18. The method as recited in claim 17, wherein the external apparatus performs:

erasing the operation information of the replaceable device determined to be at the end of its lifetime from the nonvolatile memory;

writing the guarantee information of the new replaceable device replacing the replaceable device determined to be at the end of its lifetime into the nonvolatile memory;

overwriting the guarantee information of the image forming unit with the new guarantee information generated in the generation; and erasing the operation information of the image forming unit in the nonvolatile memory.

* * * * *